US011369011B2

(12) United States Patent
Sakiyama et al.

(10) Patent No.: US 11,369,011 B2
(45) Date of Patent: Jun. 21, 2022

(54) HIGH-FREQUENCY HEATING DEVICE

(71) Applicant: Panasonic Intellectual Property Management Co., Ltd., Osaka (JP)

(72) Inventors: Kazuyuki Sakiyama, Osaka (JP); Daisuke Hosokawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/058,353

(22) PCT Filed: Apr. 3, 2019

(86) PCT No.: PCT/JP2019/014788
§ 371 (c)(1),
(2) Date: Nov. 24, 2020

(87) PCT Pub. No.: WO2020/066080
PCT Pub. Date: Apr. 2, 2020

(65) Prior Publication Data

US 2021/0120638 A1 Apr. 22, 2021

(30) Foreign Application Priority Data

Sep. 26, 2018 (JP) ..... JP2018-180677

(51) Int. Cl.
*H05B 6/54* (2006.01)
*H05B 6/48* (2006.01)
*H05B 6/62* (2006.01)

(52) U.S. Cl.
CPC ..... *H05B 6/48* (2013.01); *H05B 6/54* (2013.01); *H05B 6/62* (2013.01)

(58) Field of Classification Search
CPC ..... A23L 3/005; A23L 3/01; A23L 3/365; H02M 7/4818; H02M 7/5383;
(Continued)

(56) References Cited

U.S. PATENT DOCUMENTS

2019/0191501 A1* 6/2019 Piel ..... H05B 6/80

FOREIGN PATENT DOCUMENTS

EP 0 393 417 10/1990
JP 39-007962 3/1964
(Continued)

OTHER PUBLICATIONS

International Search Report dated Jul. 9, 2019 in International (PCT) Application No. PCT/JP2019/014788 with English translation.

(Continued)

*Primary Examiner* — Hung D Nguyen
(74) *Attorney, Agent, or Firm* — Wenderoth, Lind & Ponack, L.L.P.

(57) ABSTRACT

A high-frequency heating device that includes: a first conductor; a second conductor disposed with the first conductor through a space therebetween; a high-frequency power source that is connected to the first conductor and the second conductor and that applies a high-frequency voltage between the first conductor and the second conductor; and a connection path that electrically connects the first conductor and the second conductor to each other at a first connection position and a second connection position. The first connection position is different from a first power feeding position at which the first conductor and the high-frequency power source are connected to each other on the first conductor, and the second connection position is different from a second power feeding position at which the second conductor and the high-frequency power source are connected to each other on the second conductor.

19 Claims, 13 Drawing Sheets

(58) Field of Classification Search
CPC ..... H02M 3/338; Y02B 70/10; H05B 6/40; H05B 6/48; H05B 6/50; H05B 6/54; H05B 6/62; H05B 6/664; H05B 6/645; H05B 6/6455; H05B 6/6464; H05B 6/6467; H05B 6/686; H05B 6/688; H05B 6/70; H05B 6/705; H05B 6/72
USPC ..... 219/702–704, 770, 771, 778–780
See application file for complete search history.

(56) References Cited

FOREIGN PATENT DOCUMENTS

| | | | |
|---|---|---|---|
| JP | 50-038854 | | 4/1975 |
| JP | 63-053888 | | 3/1988 |
| JP | 3-081988 | | 4/1991 |
| JP | 2003-031350 | | 1/2003 |
| JP | 2003-31350 A | * | 1/2003 |
| JP | 2017-182885 | | 10/2017 |

OTHER PUBLICATIONS

International Preliminary Report on Patentability dated Apr. 8, 2021 in International (PCT) Patent Application No. PCT/JP2019/014788, with English Translation.
Notification of the First Office Action and Search Report dated Mar. 31, 2022 in corresponding Chinese patent application No. 201980038127.3, with English translation, 16 pages.

* cited by examiner

HIGH-FREQUENCY HEATING DEVICE

TECHNICAL FIELD

The present invention relates to a high-frequency heating device.

BACKGROUND ART

For example, a high-frequency heating device that heats a heating object by having the heating object placed therein between electrodes thereof facing each other and by applying a high-frequency voltage between the electrodes is known as a high-frequency heating device (see, e.g., Patent Document 1).

Patent Document 1 discloses a high-frequency heating device including an upper electrode, a lower electrode that is disposed under the upper electrode, and a voltage applying part that applies a high-frequency voltage between the upper electrode and the lower electrode. In the high-frequency heating device of Patent Document 1, an auxiliary electrode is disposed around the upper electrode and the voltage applying part apples a voltage different from the high-frequency voltage applied between the upper electrode and the lower electrode, between the lower electrode and the auxiliary electrode.

PRIOR ART DOCUMENT

Patent Document

Patent Document 1: Japanese Laid-Open Patent Publication No. 2017-182885

SUMMARY OF INVENTION

Technical Problem

The high-frequency heating device of Patent Document 1, however, has room for betterment with regard to an improvement of the electric power efficiency.

An object of the present invention is therefore to solve the problem and is to provide a high-frequency heating device that improves the electric power efficiency.

Solution to Problem

To achieve the object, a high-frequency heating device according to one aspect of the present invention includes a first conductor, a second conductor disposed with the first conductor through a space therebetween, a high-frequency power source that is connected to the first conductor and the second conductor and that applies a high-frequency voltage between the first conductor and the second conductor, and a connection path that electrically connects the first conductor and the second conductor to each other at a first connection position and a second connection position, the first connection position being different from a first power feeding position at which the first conductor and the high-frequency power source are connected to each other on the first conductor, and the second connection position being different from a second power feeding position at which the second conductor and the high-frequency power source are connected to each other on the second conductor.

Advantageous Effects of Invention

According to the high-frequency heating device according to the present invention, the electric power efficiency can be improved.

Figure 1:
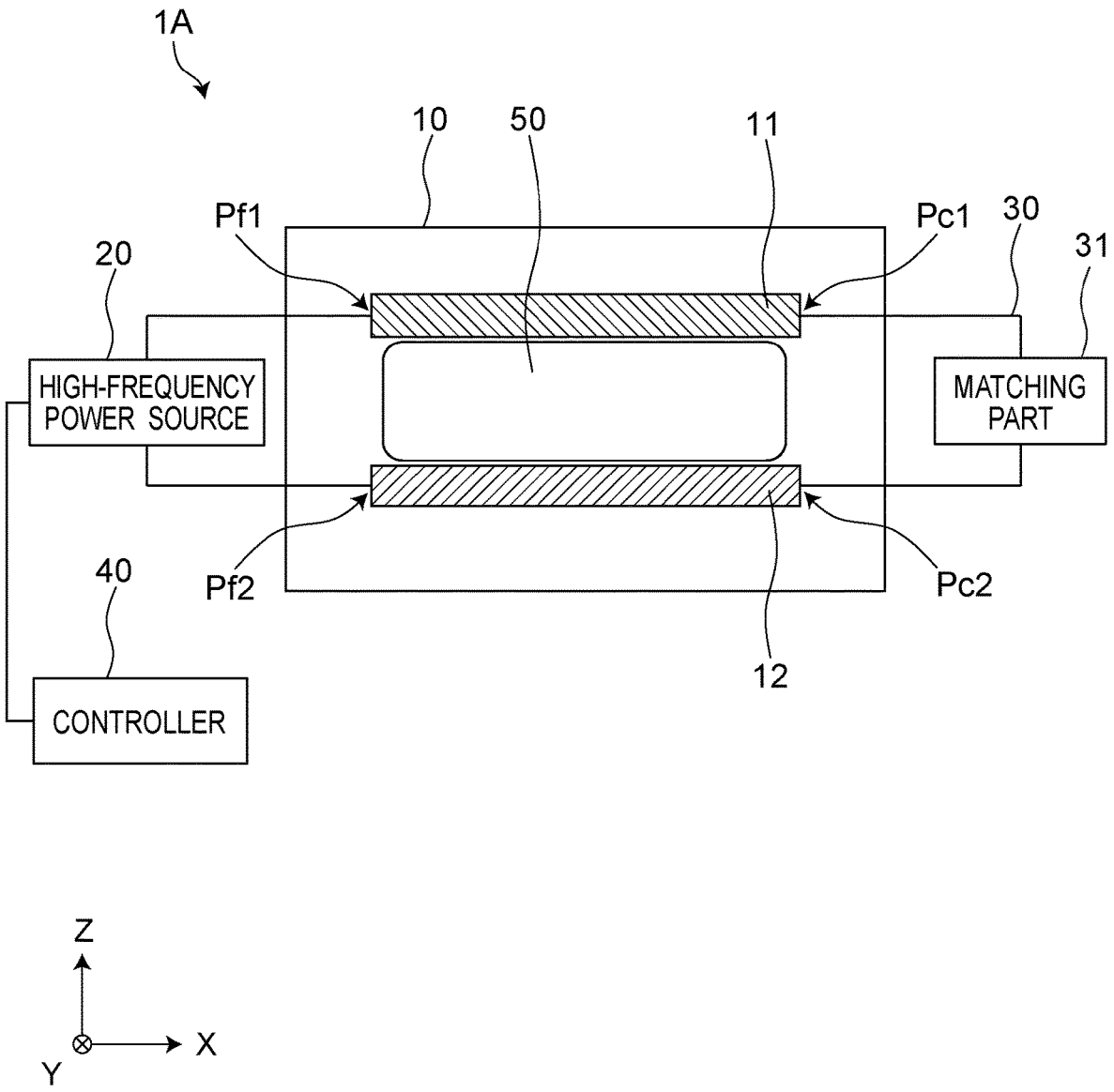
FIG. 1 is a schematic configuration diagram of one example of a high-frequency heating device according to a first embodiment of the present invention.

DESCRIPTION OF EMBODIMENTS (Finding to be Basis of this Disclosure)

The high-frequency heating device described in Patent Document 1 heats the heating object that is placed between the upper electrode and the lower electrode by generating an electric field by applying the high-frequency voltage between the upper electrode and the lower electrode.

A high-frequency heating device as above has room for betterment with regard to an improvement of the electric power efficiency.

The inventors has found that the electric power efficiency is improved by generating an electric field between a first conductor and a second conductor that is disposed with the first conductor through a space therebetween and by causing a current to flow through the first conductor and the second conductor to generate a magnetic field. The inventors has therefore found a high-frequency heating device having a connection path disposed therein that electrically connects the first conductor and the second conductor to each other at positions different from the positions at which the high-frequency power source is connected, and the inventors has completed the following invention.

A high-frequency heating device in a first aspect of the present invention includes a first conductor, a second conductor disposed with the first conductor through a space therebetween, a high-frequency power source that is connected to the first conductor and the second conductor and that applies a high-frequency voltage between the first conductor and the second conductor, and a connection path that electrically connects the first conductor and the second conductor to each other at a first connection position and a second connection position, the first connection position being different from a first power feeding position at which the first conductor and the high-frequency power source are connected to each other on the first conductor, and the second connection position being different from a second power feeding position at which the second conductor and the high-frequency power source are connected to each other on the second conductor.

A high-frequency heating device in a second aspect of the present invention may further include a matching part that is disposed in the connection path and that establishes impedance matching between the first conductor and the second conductor.

In a high-frequency heating device in a third aspect of the present invention, the matching part may include an impedance element.

In a high-frequency heating device in a fourth aspect of the present invention, the impedance element may include at least any one of a resistor and an inductor.

In a high-frequency heating device in a fifth aspect of the present invention, the matching part may include a capacitor.

In a high-frequency heating device in a sixth aspect of the present invention, the path length acquired by totaling those of the first conductor, the second conductor, and the connection path may be ½ of the wavelength at the oscillation frequency of the high-frequency power source.

A high-frequency heating device in a seventh aspect of the present invention may further include a dielectric that is disposed on at least any one of the first conductor and the second conductor between the first conductor and the second conductor.

In a high-frequency heating device in an eighth aspect of the present invention, the first conductor and the second conductor may each have one end and other end, the first power feeding position may be disposed closer to the side of the one end of the first conductor than the center of the first conductor, the second power feeding position may be disposed closer to the side of the one end of the second conductor than the center of the second conductor, the first connection position may be disposed closer to the side of the other end of the first conductor than the center of the first conductor, and the second connection position may be disposed closer to the side of the other end of the second conductor than the center of the second conductor.

In a high-frequency heating device in a ninth aspect of the present invention, the first power feeding position may be disposed at the one end of the first conductor, the second power feeding position may be disposed at the one end of the second conductor, the first connection position may be disposed at the other end of the first conductor, and the second connection position may be disposed at the other end of the second conductor.

In a high-frequency heating device in a tenth aspect of the present invention, the first conductor and the second conductor may each be formed in a flat plate and may be disposed facing each other.

In a high-frequency heating device in an eleventh aspect of the present invention, the connection path is a first connection path, the high-frequency heating device may include a second connection path that electrically connects the first conductor and the second conductor to each other at a third connection position and a fourth connection position, the third connection position being different from the first power feeding position and the first connection position on the first conductor, and the fourth connection position being different from the second power feeding position and the second connection position on the second conductor.

In a high-frequency heating device in a twelfth aspect of the present invention, on the first conductor, a first path and a second path may intersect with each other, the first path passing through the first power feeding position and the first connection position, and the second path passing through the first power feeding position and the third connection position, and on the second conductor, a third path and a fourth path may intersect with each other, the third path passing through the second power feeding position and the second connection position, and the fourth path passing through the second power feeding position and the fourth connection position.

In a high-frequency heating device in a thirteenth aspect of the present invention, the high-frequency power source may be connected to the first conductor and the second conductor at a third power feeding position and a fourth power feeding position, the third power feeding position being different from the first power feeding position, the first connection position, and the third connection position on the first conductor, and the fourth power feeding position being different from the second power feeding position, the second connection position, and the fourth connection position on the second conductor, on the first conductor, a fifth path and a sixth path may be orthogonal to each other, the fifth path passing through the first power feeding position and the first connection position, and the sixth path passing through the third power feeding position and the third connection position, and on the second conductor, a seventh path and an eighth path may be orthogonal to each other, the seventh path passing through the second power feeding position and the second connection position, and the eighth path passing through the fourth power feeding position and the fourth connection position.

In a high-frequency heating device in a fourteenth aspect of the present invention, the first conductor and the second conductor may each be formed in a meander and may be disposed facing each other.

In a high-frequency heating device in a fifteenth aspect of the present invention, the first conductor and the second conductor may each be formed in a spiral shape and may be disposed facing each other.

In a high-frequency heating device in a sixteenth aspect of the present invention, the first conductor and the second conductor may each be formed in a spiral shape and the second conductor may be disposed on the inner side of the first conductor along a winding direction of the first conductor.

Embodiments of this disclosure will be described below with reference to the accompanying drawings. To facilitate the description, each of elements is depicted being exaggerated in each of the drawings.

First Embodiment

[Overall Configuration]

Figure 2:
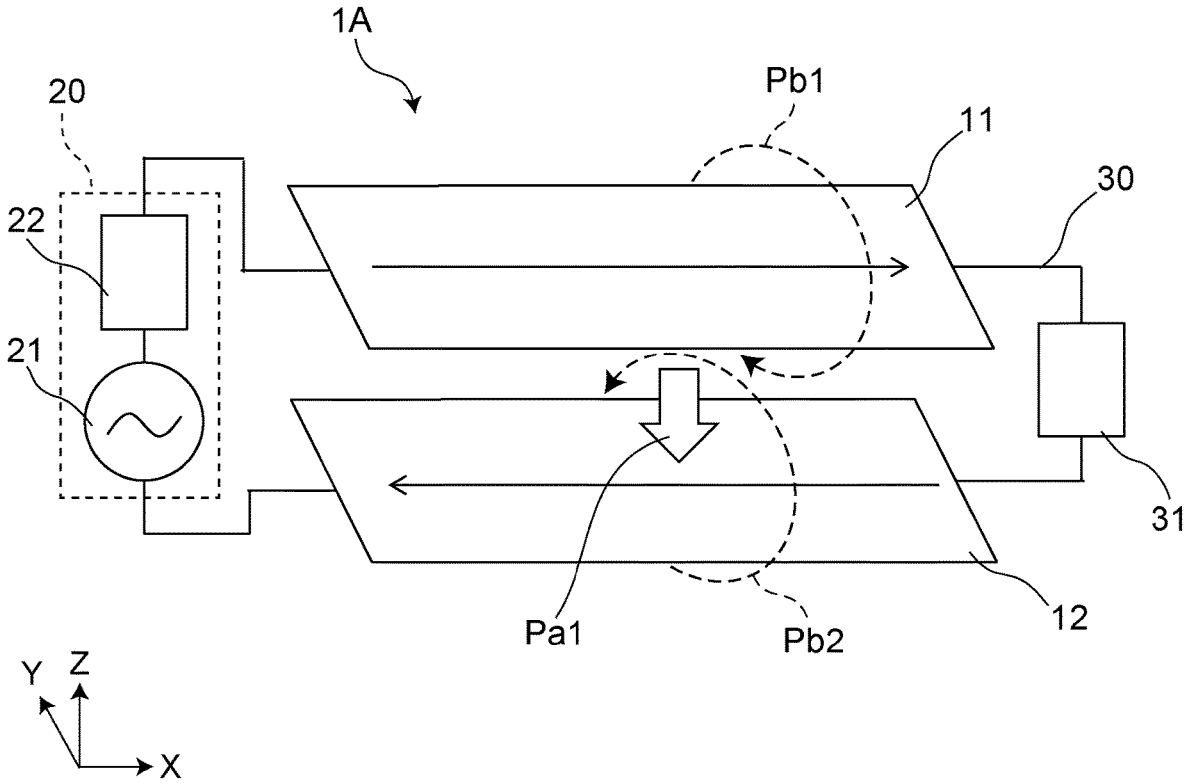
FIG. 2 is a diagram depicting one example of the basic configuration of the high-frequency heating device according to the first embodiment of the present invention.

One example of a high-frequency heating device according to a first embodiment of the present invention will be described. FIG. 1 is a schematic cross-sectional configuration diagram of one example of the high-frequency heating device 1A according to the first embodiment of the present invention. FIG. 2 depicts one example of the basic configuration of the high-frequency heating device 1A. An X-, a Y-, and a Z-directions in the drawings respectively indicate a width direction, a depth direction, and a height direction of the high-frequency heating device 1A.

As depicted in FIG. 1 and FIG. 2, the high-frequency heating device 1A includes a heating chamber 10, a first conductor 11, a second conductor 12, a high-frequency power source 20, a connection path 30, and a controller 40. The example where the high-frequency heating device 1A includes the heating chamber 10 will be described in the first embodiment while the high-frequency heating device 1A is not limited to this. The heating chamber 10 is not an essential configuration.

In the high-frequency heating device 1A, a heating object 50 is placed between the first conductor 11 and the second conductor 12, and a high-frequency voltage is applied between the first conductor 11 and the second conductor 12 by the high-frequency power source 20. An electric field Pal and magnetic fields Pb1, Pb2 are thereby generated between the first conductor 11 and the second conductor 12 to heat the heating object 50. In this manner, the high-frequency heating device 1A executes a heating process or a thawing process for the heating object 50.

<Heating Chamber>

The heating chamber 10 has a substantially cuboid structure that accommodates the heating object 50. The heating chamber 10 includes a plurality of wall faces each including a metal material, and an opening and closing door that opens and closes to accommodate therein the heating object 50. In the first embodiment, the first conductor 11 and the second conductor 12 are disposed in the heating chamber 10.

<First Conductor>

In the top view, that is, in the view from the Z-direction, the first conductor 11 is a flat plate-shaped conductor. For example, the first conductor 11 is formed in a rectangle. In the first embodiment, the first conductor 11 is disposed above the second conductor 12 in the heating chamber 10.

<Second Conductor>

In the top view, that is, in the view from the Z-direction, the second conductor 12 is a flat plate-shaped conductor. For example, the second conductor 12 is formed in a rectangle. The second conductor 12 is disposed with the first conductor through a space therebetween. In other words, the second conductor 12 is disposed facing the first conductor 11. In the first embodiment, the second conductor 12 is disposed under the first conductor 11 in the heating chamber 10 and is disposed being parallel to the first conductor 11.

<High-Frequency Power Source>

The high-frequency power source 20 is connected to the first conductor 11 and the second conductor 12, and applies a high-frequency voltage between the first conductor 11 and the second conductor 12. For example, the high-frequency power source 20 is connected to the first conductor 11 at a first power feeding position Pf1 disposed on the side of one end of the first conductor 11. The high-frequency power source 20 is connected to the second conductor 12 at a second power feeding position Pf2 disposed on the side of one end of the second conductor 12.

As depicted in FIG. 2, the high-frequency power source 20 includes a high-frequency oscillator 21 and a matching circuit 22. The high-frequency oscillator 21 oscillates a voltage signal at a frequency in an HF to a VHF bands. The matching circuit 22 establishes the impedance matching between the first conductor 11 and the second conductor 12, and the high-frequency power source 20. In the first embodiment, the high-frequency power source 20 applies a high-frequency voltage of, for example, 40 MHz between the first conductor 11 and the second conductor 12.

<Connection Path>

The connection path 30 electrically connects the first conductor 11 and the second conductor 12 to each other at positions different from the positions at which the high-frequency power source 20 is connected thereto. For example, the connection path 30 is connected to the first conductor 11 at a first connection position Pc1. The first connection position Pc1 is different from the first power feeding position Pf1 at which the first conductor 11 and the high-frequency power source 20 are connected to each other on the first conductor 11. The connection path 30 is connected to the second conductor 12 at a second connection position Pc2. The second connection position Pc2 is different from the second power feeding position Pf2 at which the second conductor 12 and the high-frequency power source 20 are connected to each other on the second conductor 12.

In this manner, one end of the connection path 30 is connected to the first connection position Pc1 and other end of the connection path 30 is connected to the second connection position Pc2. The connection path 30 thereby electrically connects the first conductor 11 and the second conductor 12 to each other.

The connection path 30 is formed by a wire such as, for example, a copper wire.

In the first embodiment, the connection path 30 has a matching part 31 disposed therein that establishes the impedance matching between the first conductor 11 and the second conductor 12. The matching part 31 includes an impedance element. Examples of the impedance element include, for example, an inductor and a resistor. In the first embodiment, the impedance element is a resistor.

<Controller>

Referring back to FIG. 1, the controller 40 controls the high-frequency power source 20. The controller 40 controls the application of the high-frequency voltage of the high-frequency power source 20. The controller 40 includes a processor (not depicted) such as, for example, a central processing unit (CPU), and a memory (not depicted) having programs stored therein that are executed by the processor.

Figure 3A:
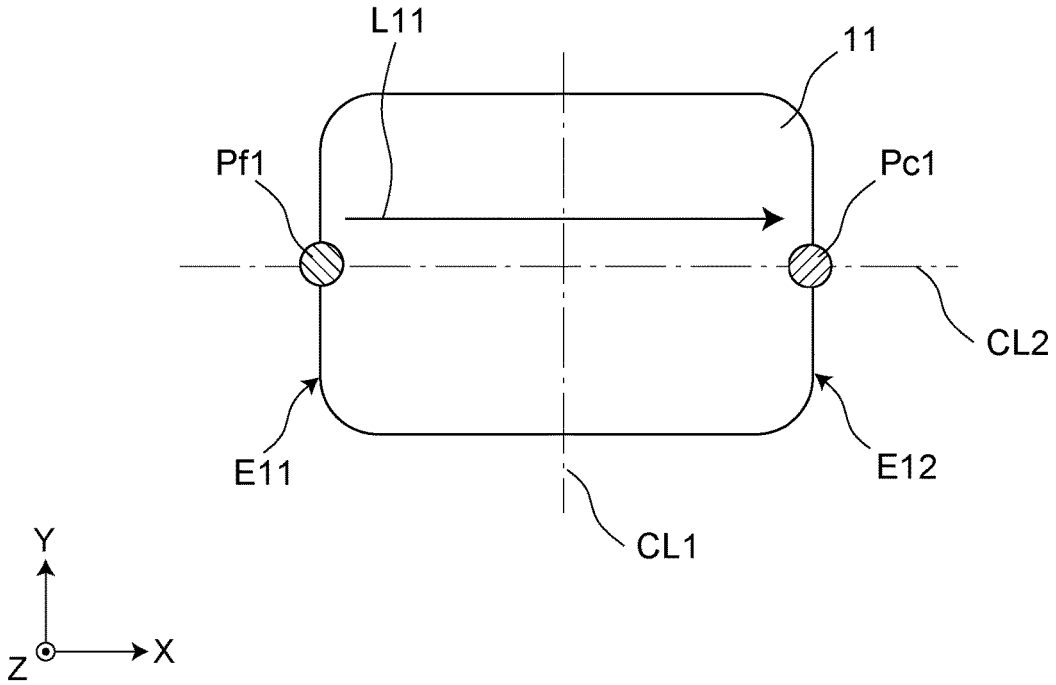
FIG. 3A is a diagram depicting one example of a power feeding position and a connection position on a first conductor.

FIG. 3A depicts one example of the power feeding position and the connection position on the first conductor. FIG. 3A is a diagram of the first conductor 11 seen from above. As depicted in FIG. 3A, on the first conductor 11, the first power feeding position Pf1, at which the high-frequency power source 20 is connected, is disposed at one end E11 of the first conductor 11. The first connection position Pc1 connected to the connection path 30 is disposed at other end E12 of the first conductor 11. On the first conductor 11, a path L11 is thereby formed that passes through the first power feeding position Pf1 and the first connection position Pc1. When the high-frequency voltage is applied between the first conductor 11 and the second conductor 12 by the high-frequency power source 20, a current flows through the path L11.

Figure 3B:
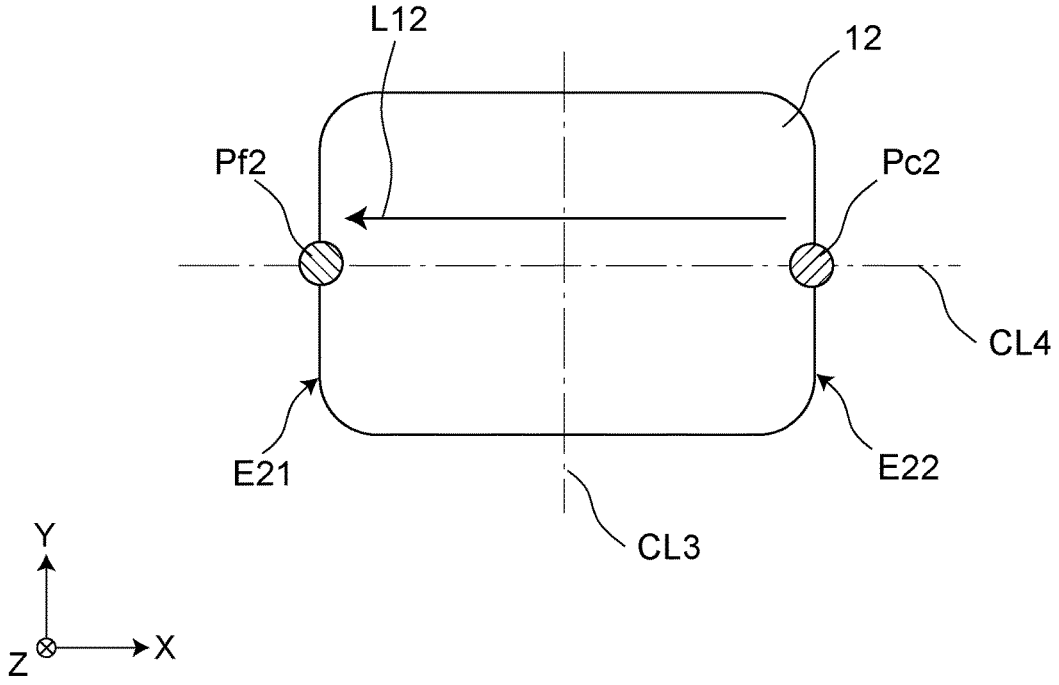
FIG. 3B is a diagram depicting one example of a power feeding position and a connection position on a second conductor.

FIG. 3B is depicts one example of the power feeding position and the connection position on the second conductor. FIG. 3B is a diagram of the second conductor 12 seen from underneath. As depicted in FIG. 3B, on the second conductor 12, the second power feeding position Pf2, at which the high-frequency power source 20 is connected, is disposed at one end E21 of the second conductor 12. The second connection position Pc2 connected to the connection path 30 is disposed at other end E22 on the second conductor 12. On the second conductor 12, a path L12 is thereby formed that passes through the second connection position Pc2 and the second power feeding position Pf2. When the high-frequency voltage is applied between the first conductor 11 and the second conductor 12 by the high-frequency power source 20, a current flows through the path L12.

In the first embodiment, the first power feeding position Pf1 and the first connection position Pc1 are disposed on a center line CL2 that extends in the width direction (the X-direction) on the first conductor 11. The center line CL2 is a line passing through the center of the length in the depth direction (the Y-direction) on the first conductor 11. The center line CL2 is present at equal distances from both side ends of the first conductor 11. The second power feeding position Pf2 and the second connection position Pc2 are disposed on a center line CL4 that extends in the width direction (the X-direction) on the second conductor 12. The center line CL4 is a line passing through the center of the length in the depth direction (the Y-direction) on the second conductor 12.

In the first embodiment, the direction of the current flowing through the first conductor 11 and the direction of the current flowing through the second conductor 12 are opposite directions to each other. For example, as depicted in FIG. 3A and FIG. 3B, when the current flows through the path L11 from the first power feeding position Pf1 toward the first connection position Pc1 on the first conductor 11, the current flows through the path L12 from the second connection position Pc2 toward the second power feeding position Pf2 on the second conductor 12.

As above, in the first embodiment, the first power feeding position Pf1, the second power feeding position Pf2, the first connection position Pc1, and the second connection position Pc2 are disposed such that the directions of the flows of the currents are opposite directions to each other between conductors whose difference in the electric potential is high like the first conductor 11 and the second conductor 12.

Figure 4:
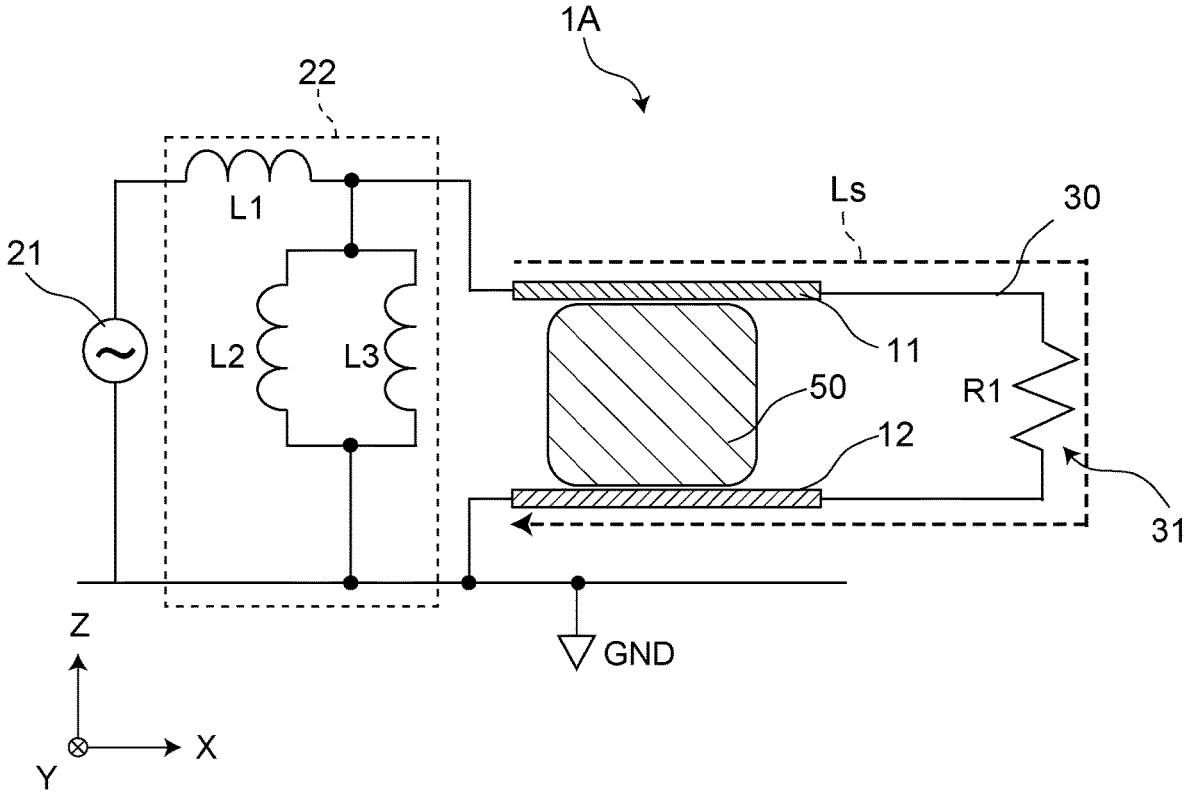
FIG. 4 is a diagram depicting the details of one example of the basic configuration of the high-frequency heating device according to the first embodiment of the present invention.

FIG. 4 depicts the details of one example of the basic configuration of the high-frequency heating device 1A according to the first embodiment of the present invention. As depicted in FIG. 4, the matching circuit 22 of the high-frequency power source 20 includes a plurality of inductors L1 to L3. For example, in the matching circuit 22, the first inductor L1 is connected in series to the second inductor L2 and the third inductor L3. The second inductor L2 and the third inductor L3 are connected in parallel to each other. The matching circuit 22 is not limited to that of this configuration.

In the first embodiment, the matching part 31 disposed in the connection path 30 includes a resistor R1. The resistor R1 as the matching part 31 is connected in series to the connection path 30.

A path length Ls acquired by totaling those of the first conductor 11, the second conductor 12, and the connection path 30 is ½ of the wavelength at the oscillation frequency of the high-frequency power source 20. The anti-node and the node of the electric field thereby respectively stay at the first conductor 11 and the second conductor 12, and the heating effect by the electric field can therefore be maximized.

[Operation]

One example of an operation of the high-frequency heating device 1A will next be described with reference to FIG. 2.

As depicted in FIG. 2, the high-frequency heating device 1A applies the high-frequency voltage between the first conductor 11 and the second conductor 12 by the high-frequency power source 20. The high-frequency power source 20 is controlled by the controller 40.

When the high-frequency voltage is applied between the first conductor 11 and the second conductor 12, the electric field Pal is generated between the first conductor 11 and the second conductor 12.

When the high-frequency voltage is applied between the first conductor 11 and the second conductor 12, the current flows from the one end of the first conductor 11 toward the other end thereof. The current flowing through the other end of the first conductor 11 passes through the connection path 30 and flows to the other end of the second conductor 12. The current flowing through the other end of the second conductor 12 next flows from the other end of the second conductor 12 toward the one end thereof. The current flows through the first conductor 11 and the second conductor 12 as above, and the magnetic fields Pb1, Pb2 are thereby generated respectively around the first conductor 11 and the second conductor 12.

In the first embodiment, the first conductor 11 and the second conductor 12 are disposed facing each other in the height direction (the Z-direction) of the high-frequency heating device 1A. The direction of the current flowing through the first conductor 11 and the direction of the current flowing through the second conductor 12 are therefore opposite directions to each other. The magnetic field Pb1 generated around the first conductor 11 and the magnetic field Pb2 generated around the second conductor 12 thereby consequently strengthen each other, and the magnetic field between the first conductor 11 and the second conductor 12 is strengthened.

As above, the high-frequency heating device 1A generates the electric field Pal and the magnetic fields Pb1, Pb2 between the first conductor 11 and the second conductor 12, and thereby heats the heating object 50 that is placed between the first conductor 11 and the second conductor 12 using the electric field Pal and the magnetic fields Pb1, Pb2. The electric power efficiency is thereby improved.

[Results of Analysis Simulations of Spatial Power Flow Distribution]

An analysis was conducted for the spatial power flow distribution in the high-frequency heating device 1A. An analysis simulation for the spatial power flow distribution was conducted using an analysis model of the high-frequency heating device 1A, as Example 1. An analysis simulation for the spatial power flow distribution was conducted using an analysis model of a high-frequency heating device not including the connection path 30, as Comparative Example 1. The analysis simulations were conducted using COMSOL Multiphysics (manufactured by COMSOL AB).

Figure 5:
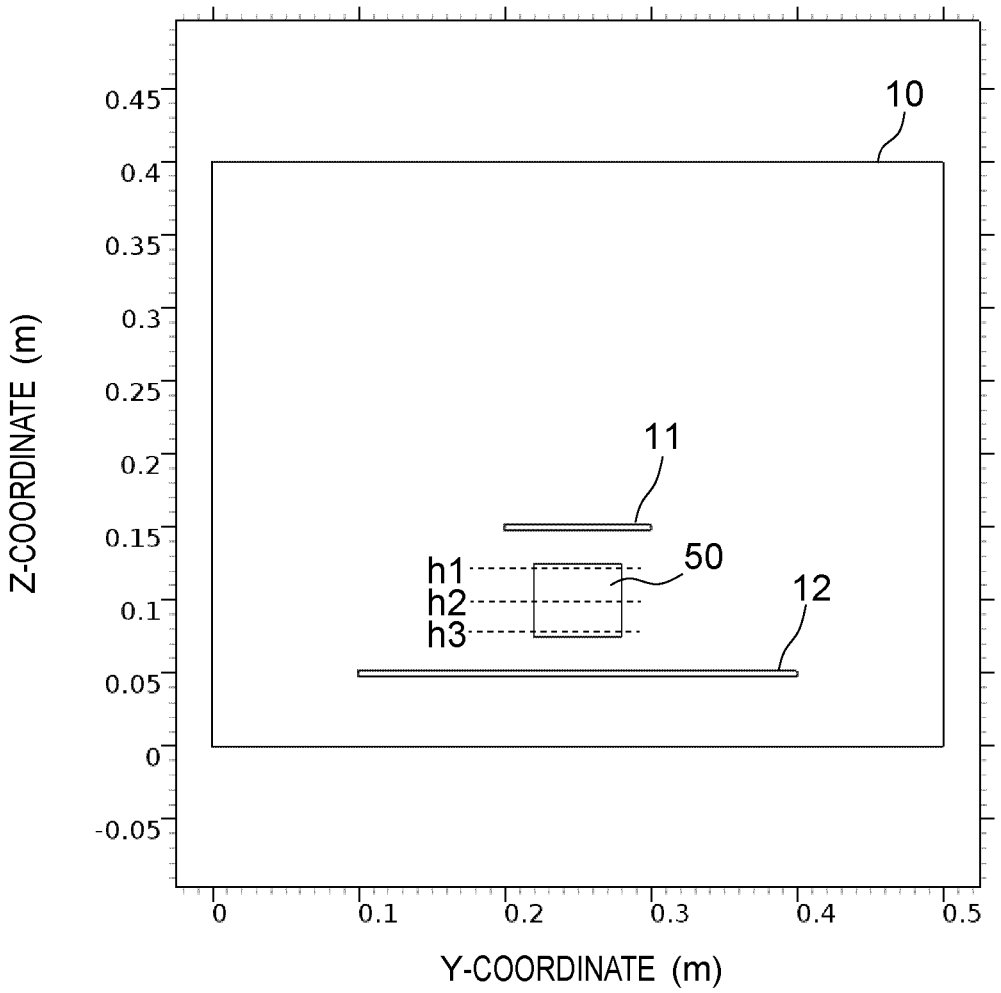
FIG. 5 is a diagram depicting one example of an analysis model of Example 1.

FIG. 5 depicts one example of the analysis model of Example 1. As depicted in FIG. 5, the analysis model of Example 1 has a configuration same as the configuration of the high-frequency heating device 1A. The analysis model of Example 1 has the configuration for generating both of the electric field and the magnetic fields between the first conductor 11 and the second conductor 12, and heats the heating object 50 placed between the first conductor 11 and the second conductor 12 using the electric field and the magnetic fields.

In Example 1, the heating object 50 was placed between the first conductor 11 and the second conductor 12 disposed in the heating chamber 10, and the analysis was conducted for the spatial power flow distribution. The size of the heating chamber 10 was 50 cm in width and 40 cm in height. The size of the heating object 50 was 6 cm in width and 5 cm in height. The bottom face of the heating object 50 is placed at a position distant from a bottom face of the heating chamber 10 by 7 cm toward an upper face thereof. An upper face of the heating object 50 is placed at a position distant from the bottom face of the heating chamber 10 by 12 cm toward the upper face thereof.

The analysis conditions of Example 1 are as follows.

Input power: 1 W

Boundary condition of each of the first conductor 11, the second conductor 12, and the heating chamber 10: Conductor The relative permittivity of the heating object 50: 2.5

In Example 1, the simulation was conducted under the above analysis conditions, and the spatial power flow distribution between the first conductor 11 and the second conductor 12 was analyzed at each of a first observation position h1, a second observation position h2, and a third observation position h3 for the heating object 50.

The first observation position h1 is positioned on the upper face of the heating object 50. The second observation position h2 is positioned at the center of the heating object 50. The third observation position h3 is positioned on the bottom face of the heating object 50. For example, the first observation position h1 is a position distant from the bottom face of the heating chamber 10 by 12 cm in the direction toward the upper face thereof. The second observation position h1 is a position distant from the bottom face of the heating chamber 10 by 10 cm in the direction toward the upper face thereof. The third observation position h3 is a position distant from the bottom face of the heating chamber 10 by 7 cm in the direction toward the upper face thereof.

Figure 6:
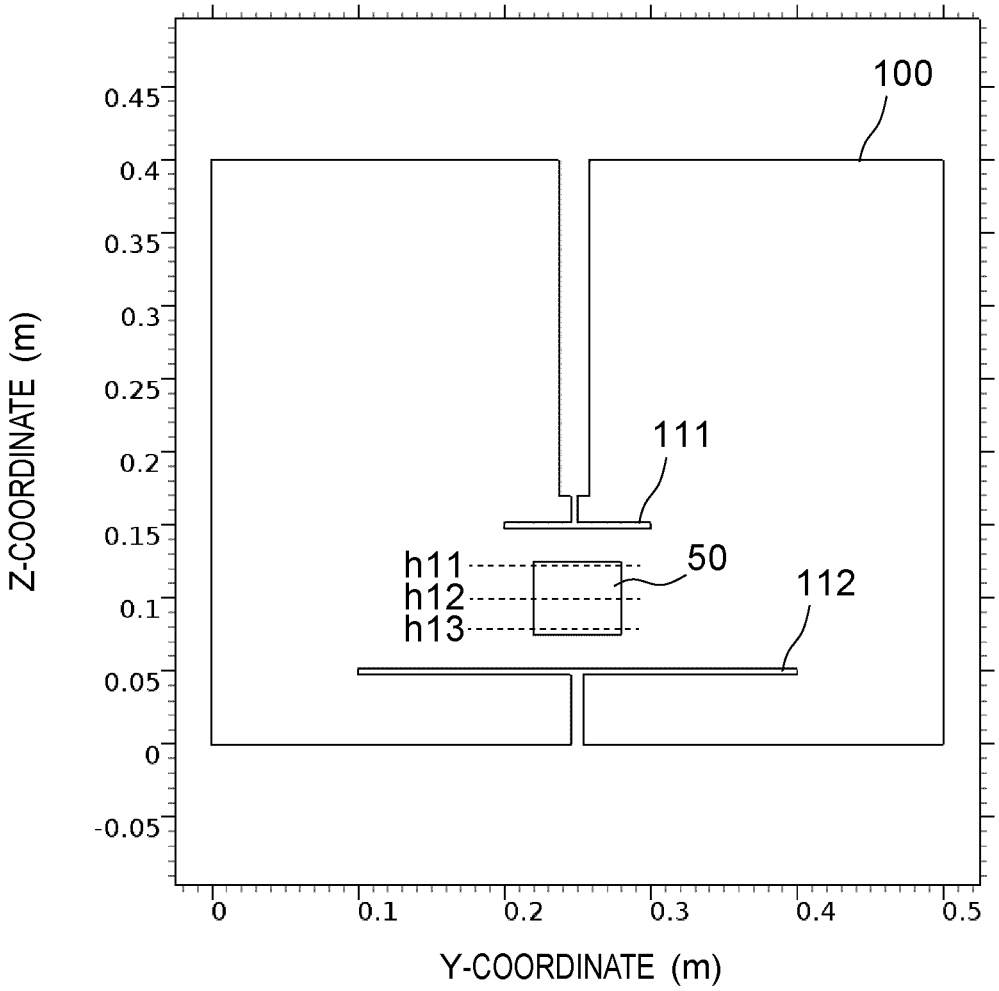
FIG. 6 is a diagram depicting one example of an analysis model of Comparative Example 1.

FIG. 6 depicts one example of an analysis model of Comparative Example 1. As depicted in FIG. 6, the analysis model of Comparative Example 1 has a configuration of a high-frequency heating device that does not include the connection path 30. The analysis model of Comparative Example 1 has a configuration for generating only an electric field between a first conductor 111 and a second conductor 112. In Comparative Example 1, the heating object 50 placed between the first conductor 111 and the second conductor 112 is heated only by the electric field.

In Comparative Example 1, the heating object 50 was placed between the first conductor 111 and the second conductor 112 disposed in a heating chamber 100 to conduct the analysis of the spatial power flow distribution. The dimensions of the analysis model of Comparative Example 1 are equal to the dimensions of the analysis model of Example 1. The dimensions of the heating object 50 and the position of its placement of Comparative Example 1 are also equal and same as those of Example 1. The analysis conditions of Comparative Example 1 are also same as the analysis conditions of Example 1. A first observation position h11, a second observation position h12, and a third observation position h13 of Comparative Example 1 are respectively similar to the first observation position h1, the second observation position h2, and the third observation position h3 of Example 1.

Figure 7:
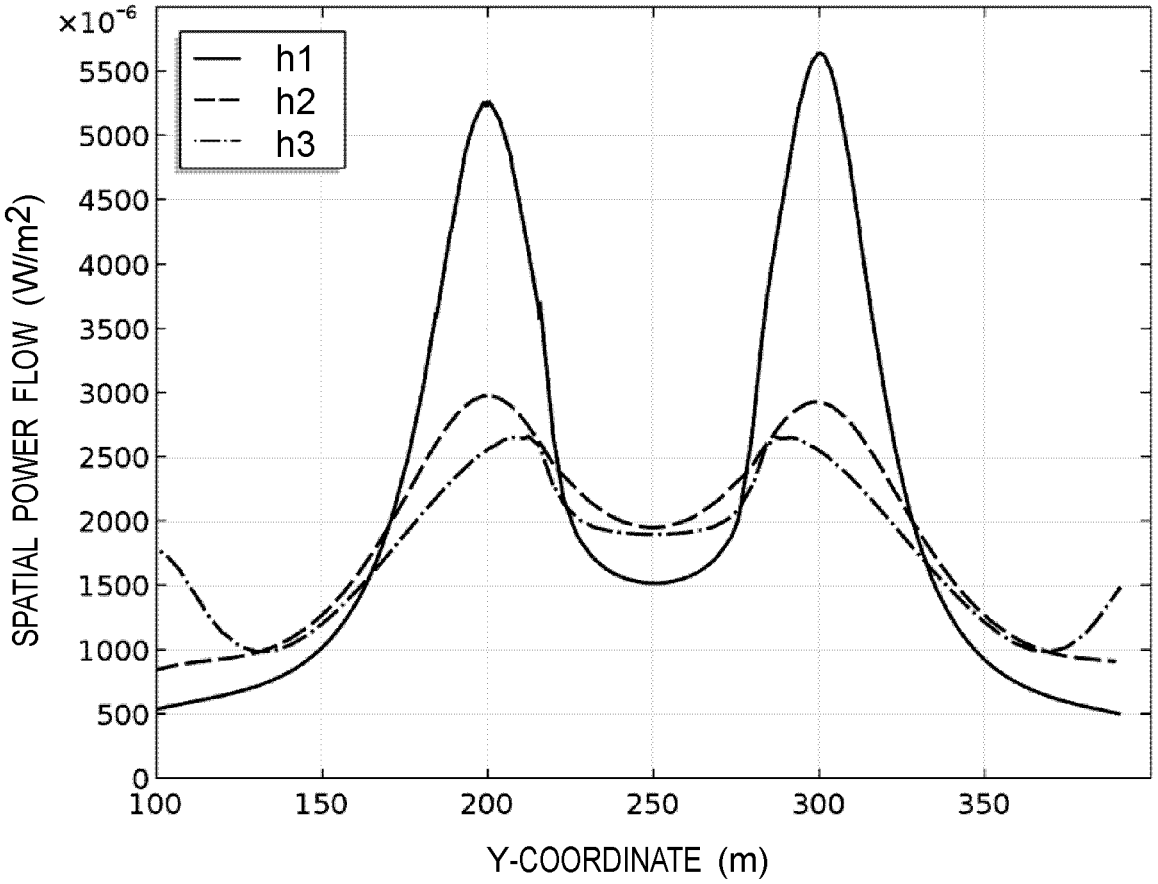
FIG. 7 is a diagram depicting one example of an analysis result of Example 1.
Figure 8:
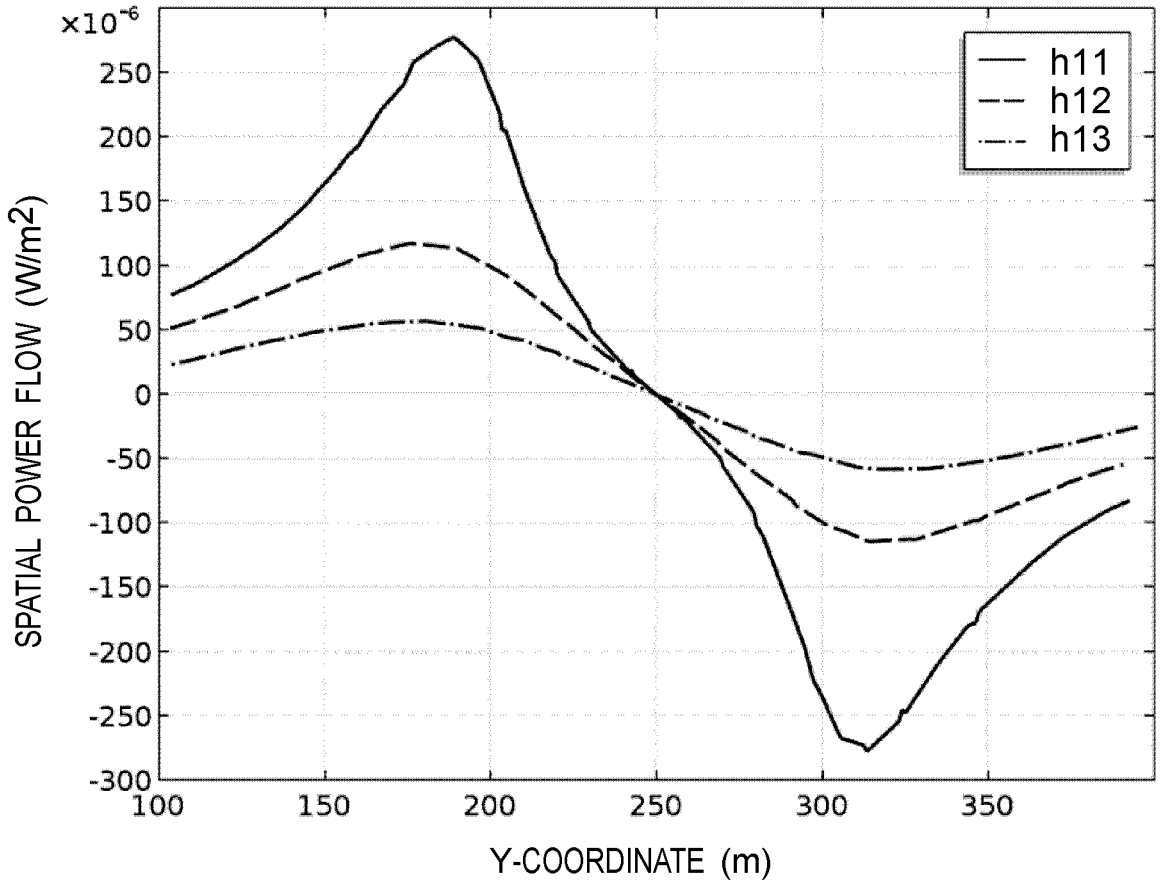
FIG. 8 is a diagram depicting one example of an analysis result of Comparative Example 1.

FIG. 7 depicts one example of an analysis result of Example 1. FIG. 8 depicts one example of an analysis result of Comparative Example 1. As depicted in FIG. 7, the spatial power distribution of Example 1 is in a range of $500\times10^{-6}$ to $5500\times10^{-6}$ [W/m$^2$]. On the other hand, as depicted in FIG. 8, the spatial power distribution of Comparative Example 1 is in a range of $-270\times10^{-6}$ to $270\times10^{-6}$ [W/m$^2$].

As above, comparing the analysis result of Example 1 and the analysis result of Comparative Example 1 with each other, Example 1 provides the large spatial power distribution compared to that of Comparative Example 1. For example, the minimal value of the spatial power distribution of Example 1 is greater than the maximal value of the spatial power distribution of Comparative Example 1. In Example 1, the spatial power distribution includes a portion that has a ten-fold or greater value compared to that of Comparative Example 1. From this fact, it is also clear that the electric power efficiency of Example 1 is notably more improved than that of Comparative Example 1.

Effects

According to the high-frequency heating device 1A of the first embodiment, the following effects can be achieved.

The high-frequency heating device 1A includes the connection path 30 that electrically connects the first conductor 11 and the second conductor 12 with each other at the first connection position Pc1 and the second connection position Pc2. The first connection position Pc1 is different from the first power feeding position Pf1 at which the first conductor 11 and the high-frequency power source 20 are connected to each other. The second connection position Pc2 is different from the second power feeding position Pf2 at which the second conductor 12 and the high-frequency power source 20 are connected to each other. With this configuration, when the high-frequency voltage is applied between the first conductor 11 and the second conductor 12 by the high-frequency power source 20, the electric field Pal can be generated between the first conductor 11 and the second conductor 12, and the magnetic fields Pb1, Pb2 can be generated. The heating object 50 placed between the first conductor 11 and the second conductor 12 can thereby be heated by the electric field Pal and the magnetic fields Pb1, Pb2. As a result, the electric power efficiency can be improved.

The high-frequency heating device 1A includes the matching part 31 that is disposed in the connection path 30 and that establishes the impedance matching between the first conductor 11 and the second conductor 12. With this configuration, the impedance matching between the first conductor 11 and the second conductor 12 can be established and any reduction of the output power can be suppressed.

The first power feeding position Pf1 is disposed at the one end E11 of the first conductor 11. The second power feeding position Pf2 is disposed at the one end E21 of the second conductor 12. The first connection position Pc1 is disposed at the other end E12 of the first conductor 11. The second connection position Pc2 is disposed at the other end E22 of the second conductor 12. With this configuration, when the high-frequency voltage is applied between the first conductor 11 and the second conductor 12 by the high-frequency power source 20, the direction of the current flowing through the first conductor 11 and the direction of the current flowing through the second conductor 12 can be set to be opposite directions to each other. The magnetic field Pb1 generated around the first conductor 11 and the magnetic field Pb2 generated around the second conductor 12 can thereby strengthen each other, and a magnetic field can be generated between the first conductor 11 and the second conductor 12. As a result, the electric power efficiency can further be improved.

The example where the high-frequency heating device 1A includes the heating chamber 10 has been described in the first embodiment while the high-frequency heating device 1A is not limited to this. The high-frequency heating device 1A may not include the heating chamber 10.

The example where the first conductor 11 and the second conductor 12 are each the flat plate-shaped conductor has been described in the first embodiment while the first conductor 11 and the second conductor 12 are not limited to this. The example where the first conductor 11 and the second conductor 12 are disposed facing each other in the height direction of the high-frequency heating device 1A has been described while the disposition thereof is not limited to this. The first conductor 11 and the second conductor 12 may be disposed with each other through a space therebetween.

The example where the high-frequency heating device 1A includes the matching part 31 disposed in the connection path 30 has been described in the first embodiment while the high-frequency heating device 1A is not limited to this. The high-frequency heating device 1A may not include the matching part 31.

The example where the matching part 31 includes the resistor R1 has been described in the first embodiment while the matching part 31 is not limited to this. The matching part 31 may include at least any one of a resistor and an inductor.

Figure 9A:
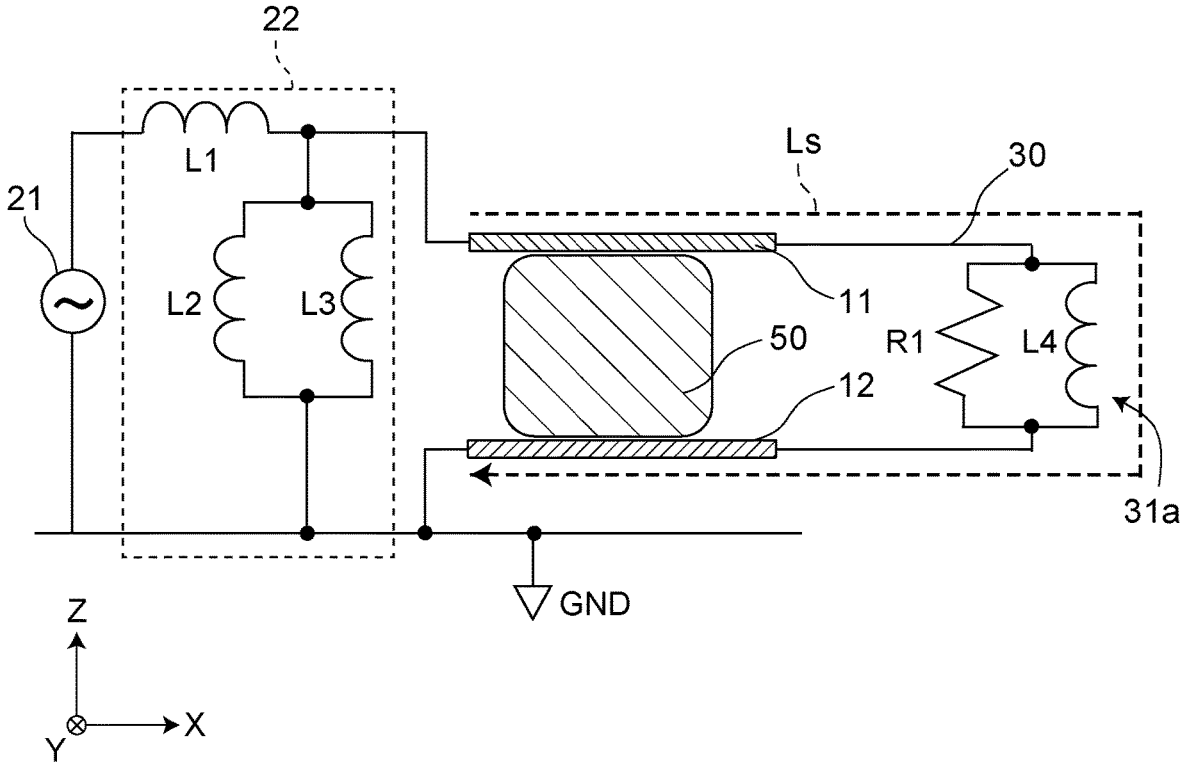
FIG. 9A is a diagram depicting one example of a matching part.

FIG. 9A depicts one example of a matching part 31*a*. As depicted in FIG. 9A, the matching part 31*a* may include the resistor R1 and an inductor L4. For example, the matching part 31*a* may also be a circuit having the resistor R1 and the inductor L4 connected therein in parallel to each other. With this configuration, the impedance matching can also be established between the first conductor 11 and the second conductor 12.

Figure 9B:
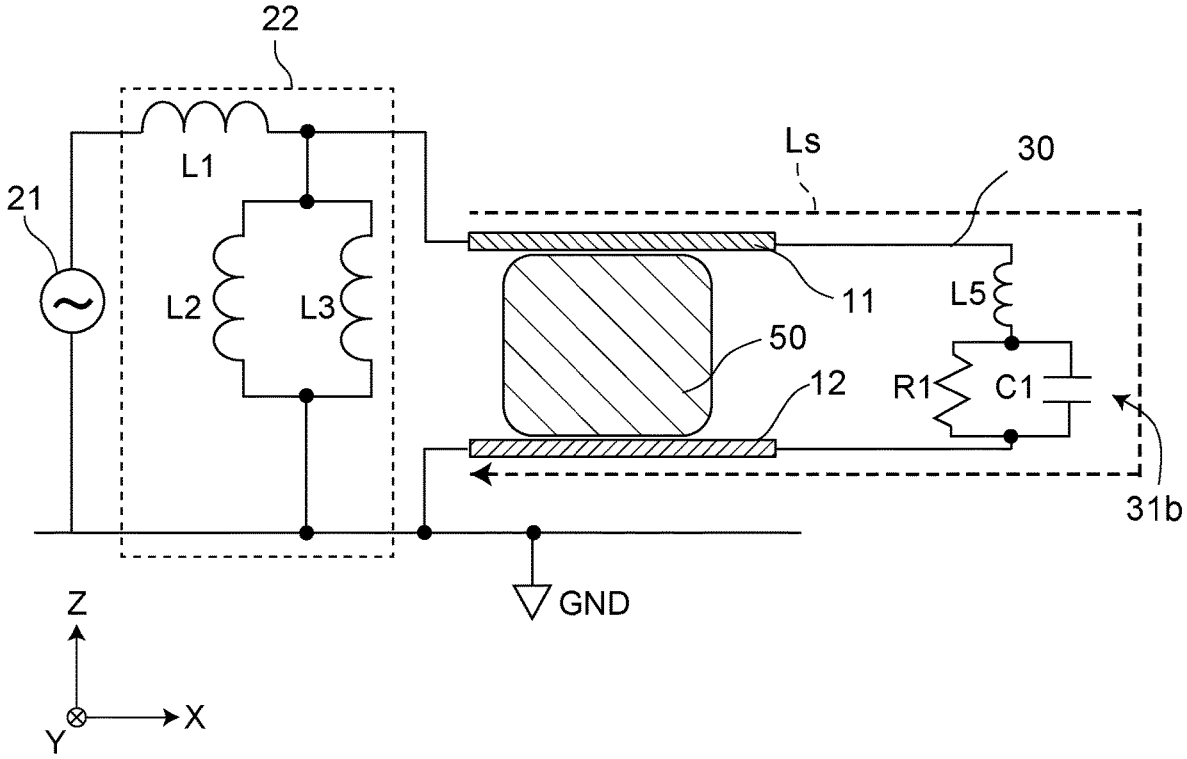
FIG. 9B is a diagram depicting one example of the matching part.

FIG. 9B depicts one example of a matching part 31*b*. As depicted in FIG. 9B, the matching part 31*b* may include the resistor R1, an inductor L5, and a capacitor C1. For example, the matching part 31*a* may be a circuit having the inductor L5, and the resistor R1 and the capacitor C1 connected therein in series with each other. The resistor R1 and the capacitor C1 are connected in parallel to each other. With this configuration, the impedance matching can also be established between the first conductor 11 and the second conductor 12.

The example where the first power feeding position Pf1 is disposed at the one end E11 of the first conductor 11, the second power feeding position Pf2 is disposed at the one end E12 of the second conductor 12, the first connection position Pc1 is disposed at the other end E12 of the first conductor 11, and the second connection position Pc2 is disposed on the other end E22 of the second conductor 12 has been described in the first embodiment while the positions are not limited to this. The first power feeding position Pf1 may be disposed closer to the side of the one end E11 of the first conductor 11 than the center t of the first conductor 11. The second power feeding position Pf2 may be disposed closer to the side of the one end E21 of the second conductor 12 than the center of the second conductor 12. The first connection position Pc1 may be disposed closer to the side of the other end E12 of the first conductor 11 than the center of the first conductor 11. The second connection position Pc2 may be disposed closer to the side of the other end E22 of the second conductor 12 than the center of the second conductor 12. The center of the first conductor 11 means the center of the length in the width direction (the X-direction) of the first conductor 11 and is the position indicated by the center line CL1 depicted in FIG. 3A. The center line CL1 is present at equal distances from the one end E11 and the other end E12 of the first conductor 11. The center of the second conductor 12 means the center of the length in the width direction (the X-direction) of the second conductor 12 and is the position indicated by the center line CL3 depicted in FIG. 3B. The center line CL3 is present at equal distances from the one end E21 and the other end E22 of the second conductor 12. With this configuration, the direction of the current flowing through the first conductor 11 and the direction of the current flowing through the second conductor 12 can also be set to be opposite directions to each other and the magnetic field generated between the first conductor 11 and the second conductor 12 can be strengthened.

Second Embodiment

A high-frequency heating device according to a second embodiment of the present invention will be described. The points different from the first embodiment will mainly be described in the second embodiment. In the second embodiment, configurations identical or similar to those of the first embodiment will be described being denoted by the same reference numerals. In the second embodiment, the same descriptions as those in the first embodiment will not again be made.

Figure 10:
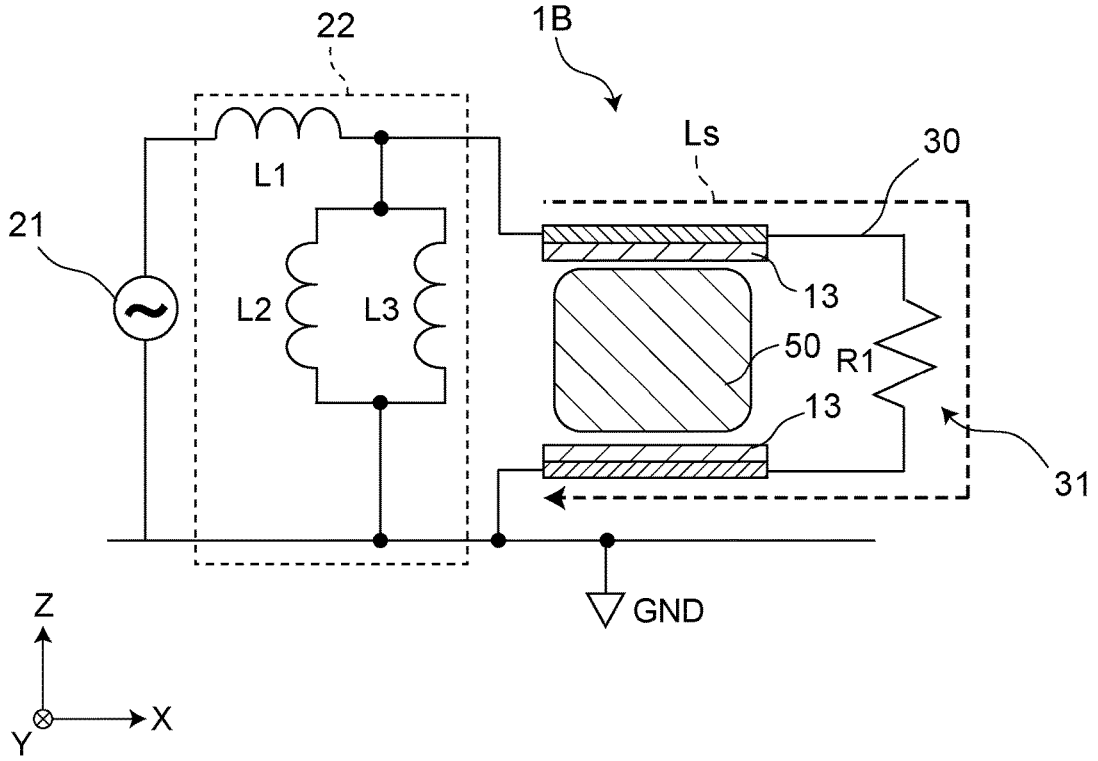
FIG. 10 is a diagram depicting one example of the basic configuration of a high-frequency heating device according to a second embodiment of the present invention.

FIG. 10 depicts one example of the basic configuration of a high-frequency heating device 1B according to the second embodiment of the present invention. As depicted in FIG. 10, the second embodiment differs from the first embodiment in that dielectrics 13 are included.

<Dielectric>

The dielectric 13 is disposed on at least any one of the first conductor 11 and the second conductor 12, between the first conductor 11 and the second conductor 12. In the second embodiment, the dielectrics 13 are disposed in contact with the first conductor 11 and the second conductor 12, respectively, between the first conductor 11 and the second conductor 12. In the second embodiment, the two dielectrics 13 are disposed facing each other, between the first conductor 11 and the second conductor 12.

In the second embodiment, the dielectrics 13 are each formed in a flat plate. For example, in the top view, that is, in the view from the Z-direction, the dielectrics 13 are each formed in a rectangle. The dielectrics 13 are each formed from, for example, a resin material such as Teflon (a registered trademark) or a glass material such as borosilicate glass.

Effects

According to the high-frequency heating device 1B of the second embodiment, the following effects can be achieved.

The high-frequency heating device 1B includes the dielectrics 13 that are disposed on the first conductor 11 and the second conductor 12, respectively, between the first conductor 11 and the second conductor 12. With this configuration, the wavelength of the high-frequency voltage of the high-frequency power source 20 can be compressed by the dielectrics 13, and the transmission path can be shortened. In the second embodiment, the path length Ls acquired by totaling those of the first conductor 11, the second conductor 12, and the connection path 30 can thereby be shortened compared to that of the first embodiment. As a result, the size of each of the first conductor 11 and the second conductor 12 can be reduced and downsizing of the device can therefore be realized.

The example where the high-frequency heating device 1B includes the two dielectrics 13 has been described in the second embodiment while the disposition of the dielectrics 13 is not limited to this. The dielectric 13 may be disposed on at least any one of the first conductor 11 and the second conductor 12, between the first conductor 11 and the second conductor 12. For example, the dielectric 13 may be disposed only on the first conductor 11, between the first conductor 11 and the second conductor 12. Otherwise, the dielectric 13 may be disposed only on the second conductor 12, between the first conductor 11 and the second conductor 12. With this configuration, the path length Ls can also be shortened and downsizing of the device can be realized.

The example where the dielectrics 13 are each formed as a rectangular flat plate has been described in the second embodiment while the shape of the dielectric 13 is not limited to this. The dielectric 13 may have an optional shape when the wavelength of the high-frequency voltage of the high-frequency power source 20 can be compressed.

Third Embodiment

A high-frequency heating device according to a third embodiment of the present invention will be described. The points different from the first embodiment will mainly be described in the third embodiment. In the third embodiment, configurations identical or similar to those of the first embodiment will be described being denoted by the same reference numerals. In the third embodiment, the same descriptions as those in the first embodiment will not again be made.

Figure 11:
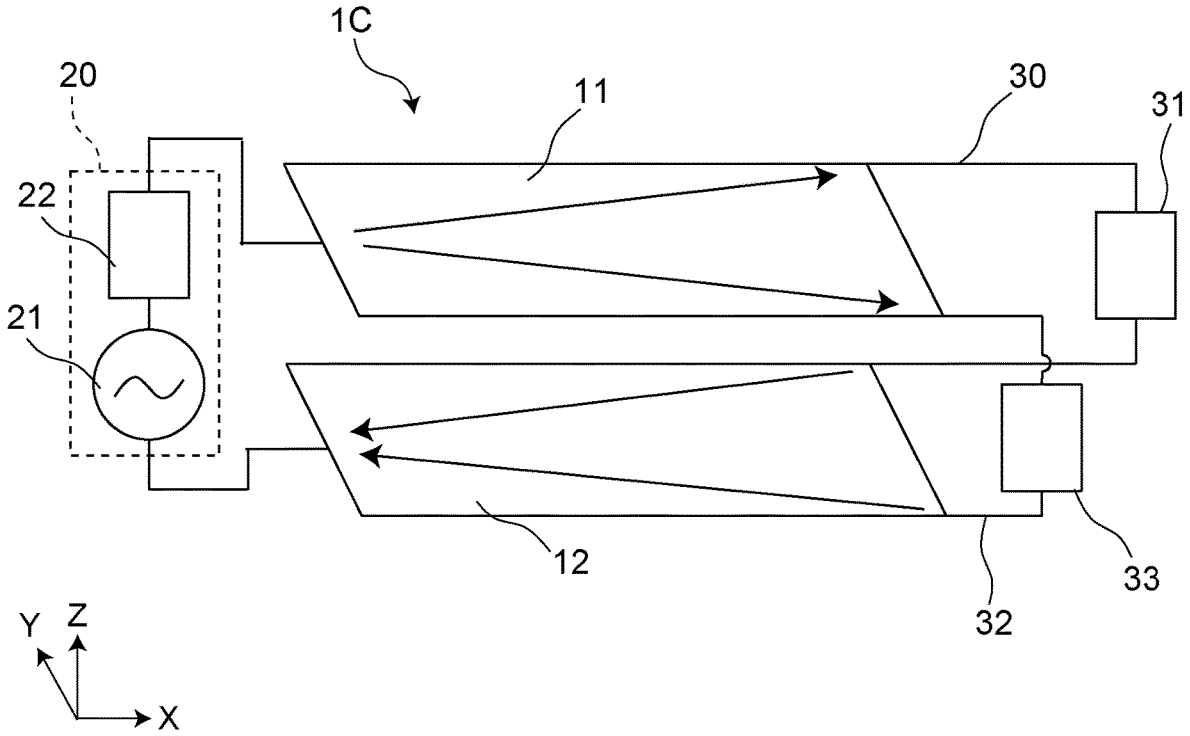
FIG. 11 is a diagram depicting one example of the basic configuration of a high-frequency heating device according to a third embodiment of the present invention.

FIG. 11 depicts one example of the basic configuration of a high-frequency heating device 1C according to the third embodiment of the present invention. As depicted in FIG. 11, the third embodiment differs from the first embodiment in that a plurality of connection paths 30, 32 are included that each connect the first conductor 11 and the second conductor 12 to each other.

In the third embodiment, the plurality of connection paths include two connection paths 30, 32. The description will be made referring to the connection path 30 as "first connection path 30" and the connection path 32 as "second connection path 32". The description will also be made referring to the matching part 31 disposed in the first connection path 30 as "first matching part 31" and a matching part 33 disposed in the second connection path 32 as "second matching part 33".

The high-frequency heating device 1C includes the first connection path 30 and the second connection path 32. The first connection path 30 electrically connects the first conductor 11 and the second conductor 12 to each other at positions different from the positions at which the high-frequency power source 20 is connected. The second connection path 32 electrically connects the first conductor 11 and the second conductor 12 to each other at positions different from the positions at which the high-frequency power source 20 and the first connection path 30 are connected.

The first connection path 30 has the first matching part 31 disposed therein that establishes the impedance matching between the first conductor 11 and the second conductor 12. The second connection path 32 has the second matching part 33 disposed therein that establishes the impedance matching between the first conductor 11 and the second conductor 12.

The first matching part 31 and the second matching part 33 each include an impedance element. Examples of the impedance element include, for example, an inductor and a resistor. In the third embodiment, the impedance element included in each of the first matching part 31 and the second matching part 33 is a resistor.

Figure 12A:
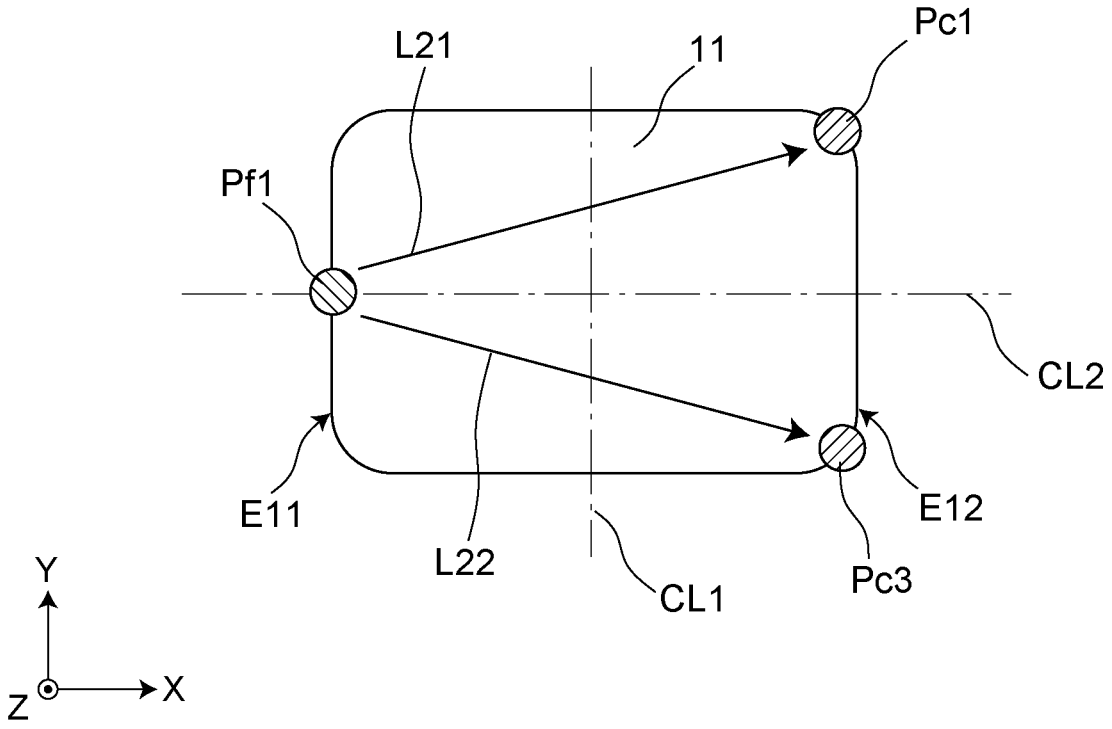
FIG. 12A is a diagram depicting one example of a power feeding position and connection positions on the first conductor of the high-frequency heating device according to the third embodiment of the present invention.

FIG. 12A depicts one example of a power feeding position and connection positions on the first conductor 11 of the high-frequency heating device 1C according to the third embodiment of the present invention. As depicted in FIG. 12A, at the other end E12 of the first conductor 11, the first connection position Pc1 is disposed at a position distant in the depth (the Y-direction) from the center line CL2 extending in the width direction (the X-direction) of the first conductor 11. At the other end E12 of the first conductor 11, the third connection position Pc3 is disposed at a position that is distant in the depth direction (the Y-direction) from the center line CL2 extending in the width direction (the X-direction) of the first conductor 11 and that is distant on the opposite side to that of the position at which the first connection position Pc1 is disposed.

For example, the first connection position Pc1 is disposed in a first corner portion of the other end E12 of the first conductor 11. The third connection position Pc3 is disposed in a second corner portion of the other end E12 of the first conductor 11. The second corner portion of the first conductor 11 is positioned on the opposite side to that of the first corner portion of the first conductor 11 across the center line CL2 that extends in the width direction (the X-direction) of the first conductor 11.

On the first conductor 11, a first path L21 and the second path L22 are thereby formed. The first path L21 passes through the first power feeding position Pf1 and the first connection position Pc1. The second path L22 passes through the first power feeding position Pf1 and the third connection position Pc3. The first path L21 and the second path L22 intersect with each other. When the high-frequency voltage is applied between the first conductor 11 and the second conductor 12 by the high-frequency power source 20, a current flows through each of the first path L21 and the second path L22.

Figure 12B:
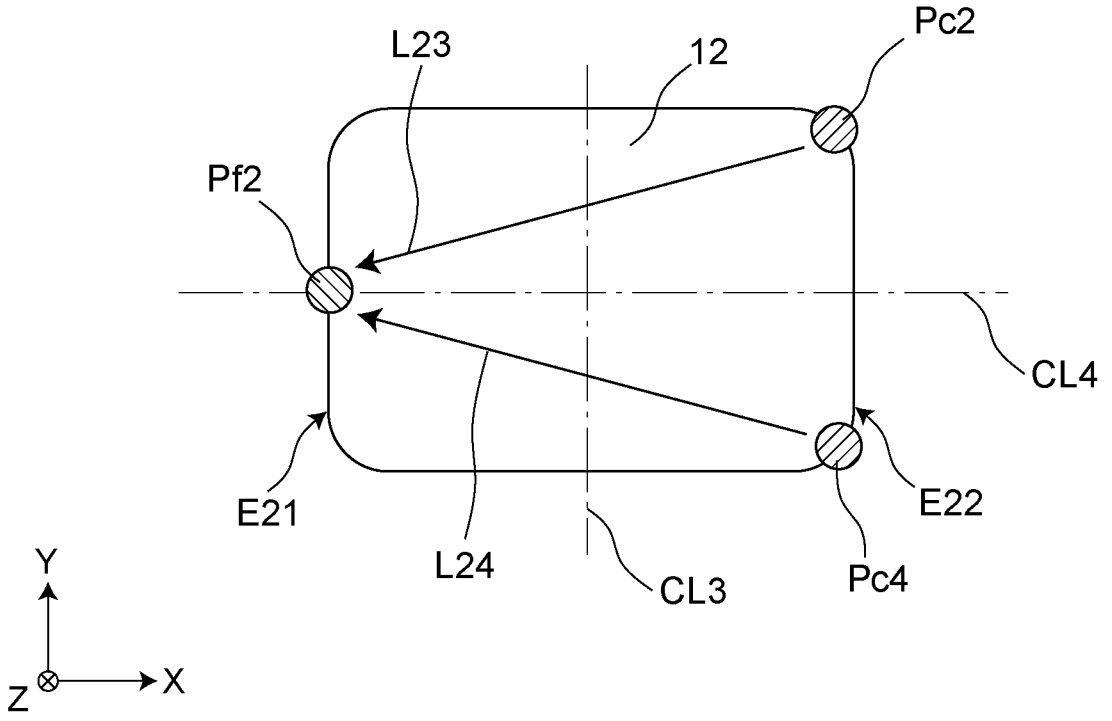
FIG. 12B is a diagram depicting one example of a power feeding position and connection positions on the second conductor of the high-frequency heating device according to the third embodiment of the present invention.

FIG. 12B depicts one example of a power feeding position and connection positions on the second conductor 12 of the high-frequency heating device 1C according to the third embodiment of the present invention. As depicted in FIG. 12B, at the other end E22 of the second conductor 12, the second connection position Pc2 is disposed at a position distant in the depth (the Y-direction) from the center line CL4 extending in the width direction (the X-direction) of the second conductor 12. At the other end E22 of the second conductor 12, the fourth connection position Pc4 is disposed at a position that is distant in the depth direction (the Y-direction) from the center line CL4 extending in the width direction (the X-direction) of the second conductor 12 and that is distant on the opposite side to that of the position at which the second connection position Pc2 is disposed.

For example, the second connection position Pc2 is disposed in a first corner portion of the other end E22 of the second conductor 12. The fourth connection position Pc4 is disposed in a second corner portion of the other end E22 of the second conductor 12. The second corner portion of the second conductor 12 is positioned on the opposite side to that of the first corner portion of the second conductor 12 across the center line CL4 that extends in the width direction (the X-direction) of the second conductor 12. The second power feeding position Pf2 is disposed on the center line CL4 of the second conductor 12 at the one end E21 of the second conductor 12.

On the second conductor 12, a third path L23 and a fourth path L24 thereby are formed. The third path L23 passes through the second power feeding position Pf2 and the second connection position Pc2. The fourth path L24 passes through the second power feeding position Pf2 and the fourth connection position Pc4. The third path L23 and the fourth path L24 intersect with each other. When the high-frequency voltage is applied between the first conductor 11 and the second conductor 12 by the high-frequency power source 20, a current flows through each of the third path L23 and the fourth path L24.

As above, the high-frequency heating device 1C includes the first connection path 30 that electrically connects the first conductor 11 and the second conductor 12 to each other at the first connection position Pc1 and the second connection position Pc2. The first connection position Pc1 is different from the first power feeding position Pf1 on the first conductor 11. The second connection position Pc2 is different from the second power feeding position Pf2 on the second conductor 12. The high-frequency heating device 1C includes the second connection path 32 that electrically connects the first conductor 11 and the second conductor 12 to each other at the third connection position Pc3 and the fourth connection position Pc4. The third connection position Pc3 is different from the first power feeding position Pf1 and the first connection position Pc1 on the first conductor 11. The fourth connection position Pc4 is different from the second power feeding position Pf2 and the second connection position Pc2 on the second conductor 12.

Effects

According to the high-frequency heating device 1C of the third embodiment, the following effects can be achieved.

The high-frequency heating device 1C includes the plurality of connection paths 30, 32 each electrically connecting the first conductor 11 and the second conductor 12 to each other. For example, the high-frequency heating device 1C includes the second connection path 32 that electrically connects the first conductor 11 and the second conductor 12 to each other at the third connection position Pc3 and the fourth connection position Pc4. The third connection position Pc3 is different from the first power feeding position Pf1 and the first connection position Pc1 on the first conductor 11. The fourth connection position Pc4 is different from the second power feeding position Pf2 and the second connection position Pc2 on the second conductor 12. With this configuration, the paths of the currents flowing through the first conductor 11 and the second conductor 12 can be increased. Compared to the first and the second embodiments, the heating distribution by the magnetic field can thereby be spread and the heating object 50 can evenly be heated in the high-frequency heating device 1C.

In the high-frequency heating device 1C, on the first conductor 11, the first path L21 and the second path L22 intersect with each other. The first path L21 passes through the first power feeding position Pf1 and the first connection position Pc1 The second path L22 passes through the first power feeding position Pf1 and the third connection position Pc3. On the second conductor 12, the third path L23 and the fourth connection position Pc4 intersect with each, other. The third path L23 passes through the second power feeding position Pf2 and the second connection position Pc2. The fourth path L24 passes through the second power feeding position Pf2 and the fourth connection position Pc4. With this configuration, mutual cancellation by the magnetic fields generated by the first conductor 11 and the second conductor 12 can be suppressed and the electric power efficiency can further be improved.

The example where the plurality of connection paths include the two connection paths 30, 32 has been described in the third embodiment while the connection paths are not limited to this. The plurality of connection paths may include two or more connection paths.

The example where, on the first conductor 11, the first connection position Pc1 is formed in the first corner portion on the side of the other end E12 of the first conductor 11 and the third connection position Pc3 is formed in the second corner portion on the opposite side to that of the first corner portion across the center line CL2 that extends in the width direction (the X-direction) of the first conductor 11 has been described in the third embodiment while the positions are not limited to this. The first connection position Pc1 and the third connection position Pc3 may not be formed in the first corner portion and the second corner portion of the first conductor 11. The first connection position Pc1 and the third connection position Pc3 may be formed on the first conductor 11. Similarly, the example where, on the second conductor 12, the second connection position Pc2 is formed in the first corner portion on the side of the other end E22 of the second conductor 12 and the fourth connection position Pc4 is formed in the second corner portion on the opposite side to that of the first corner portion across the center line CL4 that extends in the width direction (the X-direction) of the second conductor 12 has been described while the positions are not limited to this. The second connection position Pc2 and the fourth connection position Pc4 may not be formed in the first corner portion and the second corner portion of the second conductor 12. The second connection position Pc2 and the fourth connection position Pc4 may be formed on the second conductor 12. With this configuration, the heating distribution by the magnetic field can be spread and the heating object 50 can evenly be heated.

The example where, on the first conductor 11, the first path L21 passing through the first power feeding position Pf1 and the first connection position Pc1, and the second path L22 passing through the first power feeding position Pf1 and the third connection position Pc3 intersect with each other has been described in the third embodiment while the paths are not limited to this. The example where, on the second conductor 12, the third path L23 passing through the second power feeding position Pf2 and the second connection position Pc2, and the fourth path L24 passing through the second power feeding position Pf2 and the fourth connection position Pc4 intersect with each other has been described while the paths are not limited to this.

The example where the one first power feeding position Pf1 is disposed on the first conductor 11 and the one second power feeding position Pf2 is disposed on the second conductor 12 has been described in the third embodiment while the positions are not limited to this. The plurality of power feeding positions may be disposed on each of the first conductor 11 and the second conductor 12. With this configuration, the heating distribution by the magnetic field can also be spread and the heating object 50 can evenly be heated.

Figure 13A:
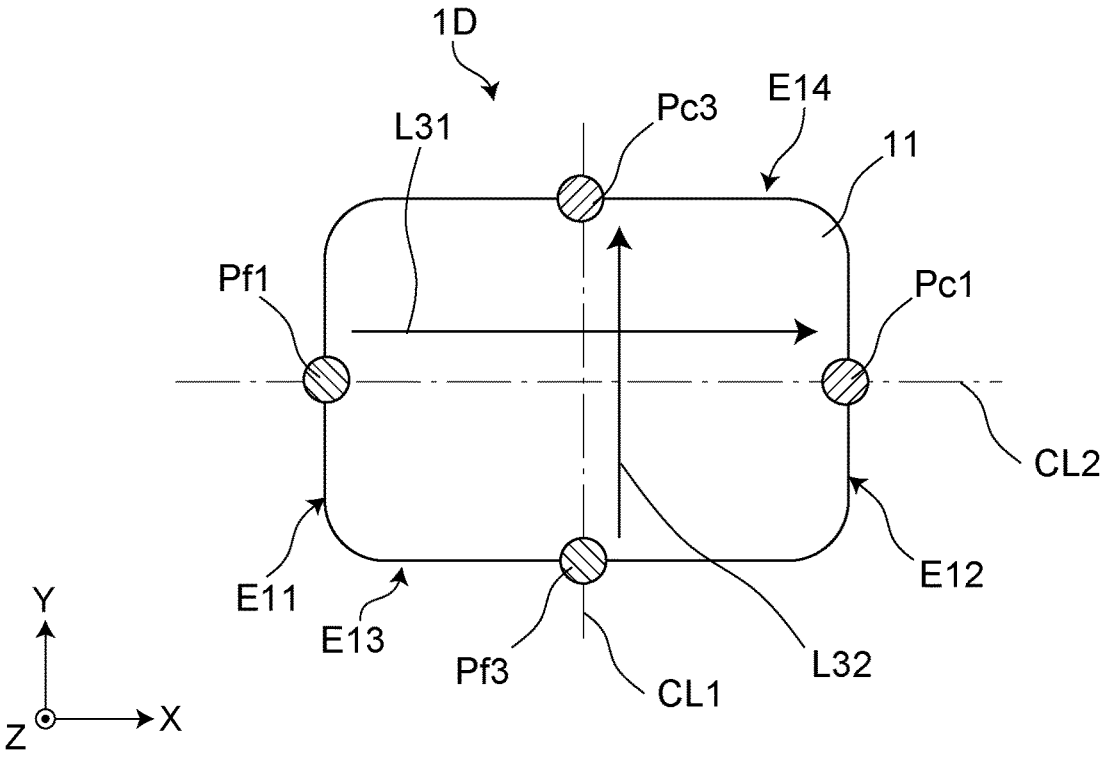
FIG. 13A is a diagram depicting one example of power feeding positions and connection positions on the first conductor of a high-frequency heating device of Modification Example.
Figure 13B:
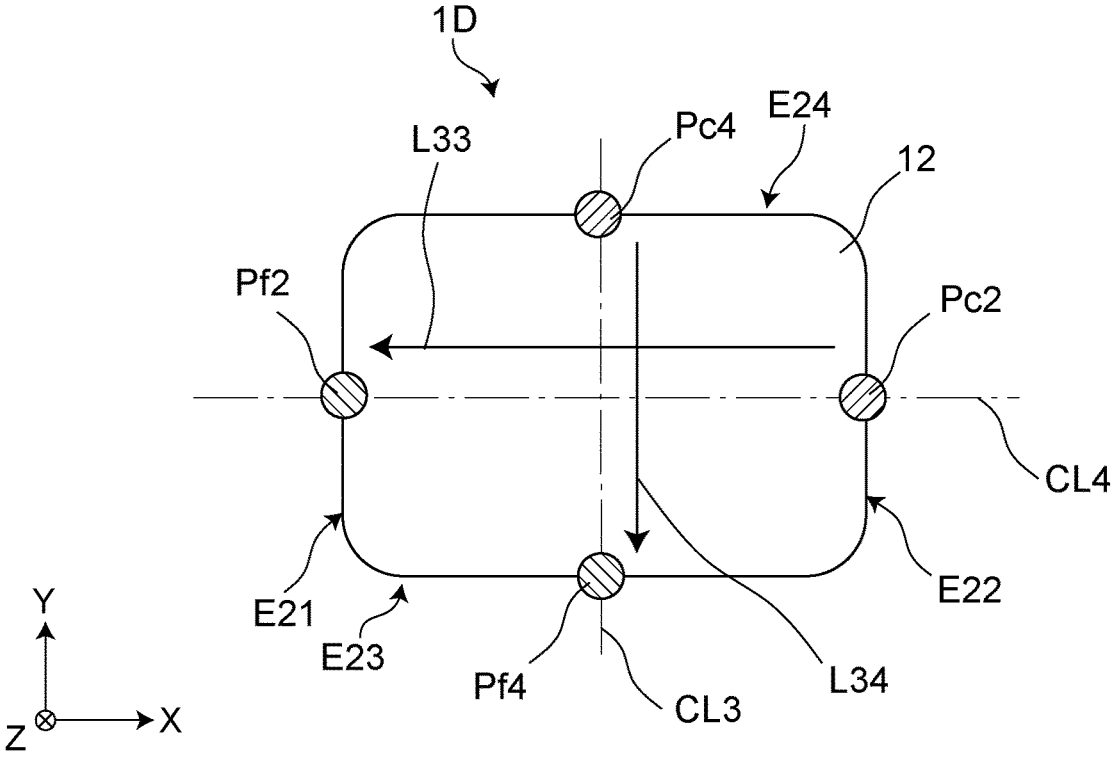
FIG. 13B is a diagram depicting one example of power feeding positions and connection positions on the second conductor of the high-frequency heating device of Modification Example.

FIG. 13A depicts one example of power feeding positions and connection positions on the first conductor 11 of a high-frequency heating device 1D of Modification Example. FIG. 13B depicts one example of power feeding positions and connection positions on the second conductor 12 of the high-frequency heating device 1D of Modification Example. As depicted in FIG. 13A, the two power feeding positions Pf1, Pf3 are disposed on the first conductor 11. For example, the first power feeding position Pf1 is disposed at the one end E11 of the first conductor 11. The third power feeding position Pf3 is disposed at a side end E13 of the first conductor 11. The first power feeding position Pf1 and the third power feeding position Pf3 are connected to the high-frequency power source 20.

The two connection positions Pc1, Pc3 are disposed on the first conductor 11. For example, the first connection position Pc1 is disposed at the other end E12 of the first conductor 11. The third connection position Pc3 is disposed at a side end E14 on the opposite side to that of the side end E13 of the first conductor 11. The first connection position Pc1 is connected to the first connection path 30. The third connection position Pc3 is connected to the second connection path 32.

The first power feeding position Pf1 and the first connection position Pc1 are positioned on the center line CL2 extending in the width direction (the X-direction) of the first conductor 11, and the third power feeding position Pf3 and the third connection position Pc3 are positioned on the center line CL1 extending in the depth direction (the Y-direction) of the first conductor 11.

On the first conductor 11, a fifth path L31 and a sixth path L32 are formed. The fifth path L31 passes through the first power feeding position Pf1 and the first connection position Pc1. The sixth path L32 passes through the third power feeding position Pf3 and the third connection position Pc3. The fifth path L31 and the sixth path L32 are orthogonal to each other. When the high-frequency voltage is applied between the first conductor 11 and the second conductor 12 by the high-frequency power source 20, a current flows through each of the fifth path L31 and the sixth path L32.

As depicted in FIG. 13B, the two power feeding positions Pf2, Pf4 are disposed on the second conductor 12. For example, the second power feeding position Pf2 is disposed at the one end E21 of the second conductor 12. The fourth power feeding position Pf4 is disposed at a side end E23 of the second conductor 12. The second power feeding position Pf2 and the fourth power feeding position Pf4 are connected to the high-frequency power source 20.

The two connection positions Pc2, Pc4 are disposed on the second conductor 12. For example, the second connection position Pc2 is disposed at the other end E22 of the second conductor 12. The fourth connection position Pc4 is disposed at a side end E24 on the opposite side to that of the side end E23 of the second conductor 12. The second connection position Pc2 is connected to the first connection path 30. The fourth connection position Pc4 is connected to the second connection path 32.

The second power feeding position Pf2 and the second connection position Pc2 are positioned on the center line CL4 extending in the width direction (the X-direction) of the second conductor 12. The fourth power feeding position Pf4 and the fourth connection position Pc4 are positioned on the center line CL3 extending in the depth direction (the Y-direction) of the second conductor 12.

On the second conductor 12, a seventh path L33 passing through the second power feeding position Pf2 and the second connection position Pc2, and an eighth path L34 passing through the fourth power feeding position Pf4 and the fourth connection position Pc4 are formed. The seventh path L33 and the eighth path L34 are orthogonal to each other. When the high-frequency voltage is applied between the first conductor 11 and the second conductor 12 by the high-frequency power source 20, a current flows through each of the seventh path L33 and the eighth path L34.

With this configuration, when the high-frequency voltage is applied between the first conductor 11 and the second conductor 12, the direction of the current flowing through the fifth path L31 of the first conductor 11 and the direction of the current flowing through the seventh path L33 of the second conductor 12 are opposite directions to each other. The direction of the current flowing through the sixth path L32 of the first conductor 11 and the direction of the current flowing through the eighth path L34 of the second conductor 12 are opposite directions to each other. The magnetic field generated by the current flowing through the fifth path L31 of the first conductor 11 and the magnetic field generated by the current flowing through the seventh path L33 of the second conductor 12 thereby strengthen each other. The magnetic field generated by the current flowing through the sixth path L32 of the first conductor 11 and the magnetic field generated by the current flowing through the eighth path L34 of the second conductor 12 thereby strengthen each other. As a result, in the high-frequency heating device 1D, the heating by the magnetic field can be strengthened and a further improvement of the electric power efficiency can be realized.

The fifth path L31 and the sixth path L32 are orthogonal to each other on the first conductor 11, and the seventh path L33 and the eighth path L34 are orthogonal to each other on the second conductor 12, and mutual cancellation by the magnetic fields generated by the paths can thereby be suppressed. The electric power efficiency can thereby be further improved.

Fourth Embodiment

A high-frequency heating device according to a fourth embodiment of the present invention will be described. The points different from the first embodiment will mainly be described in the fourth embodiment. In the fourth embodiment, configurations identical or similar to those of the first embodiment will be described being denoted by the same reference numerals. In the fourth embodiment, the same descriptions as those in the first embodiment will not again be made.

Figure 14:
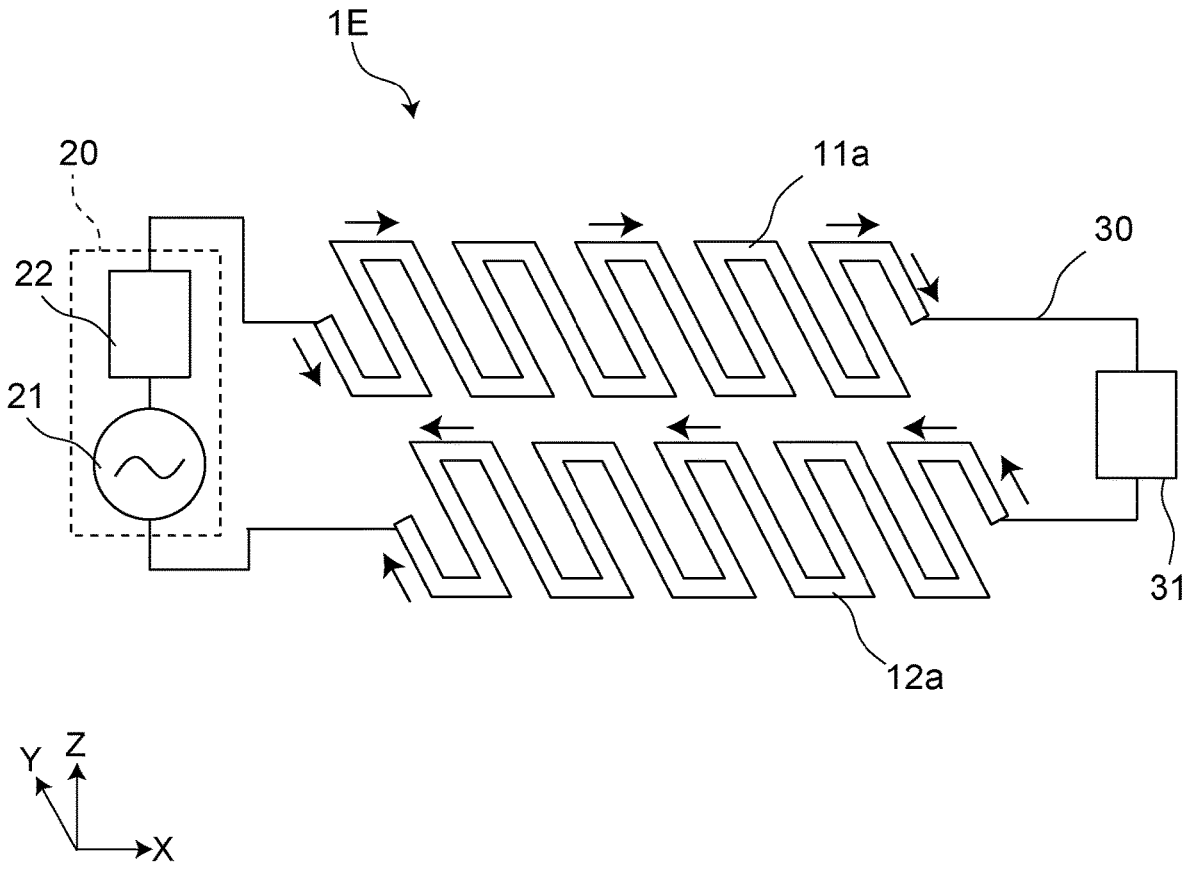
FIG. 14 is a diagram depicting one example of the basic configuration of a high-frequency heating device according to a fourth embodiment of the present invention.

FIG. 14 depicts one example of the basic configuration of a high-frequency heating device 1E according to the fourth embodiment of the present invention. As depicted in FIG. 14, the fourth embodiment differs from the first embodiment in that a first conductor 11*a* and a second conductor 12*a* are each formed in a meander.

In the high-frequency heating device 1E, the first conductor 11*a* and the second conductor 12*a* each extend in a meander in the width direction (the X-direction) of the high-frequency heating device 1E. The first conductor 11*a* and the second conductor 12*a* are disposed facing each other.

In the fourth embodiment, the high-frequency power source 20 is connected to one end of the first conductor 11*a* and one end of the second conductor 12*a*. The connection path 30 is connected to other end of the first conductor 11*a* and other end of the second conductor 12*a*.

When the high-frequency voltage is applied between the first conductor 11*a* and the second conductor 12*a* by the high-frequency power source 20, in the portion having the first conductor 11*a* and the second conductor 12*a* therein facing each other, the direction of the current flowing through the first conductor 11*a* and the direction of the current flowing through the second conductor 12*a* are opposite directions to each other.

Effects

According to the high-frequency heating device 1E of the fourth embodiment, the following effects can be achieved.

According to the high-frequency heating device 1E, the first conductor 11*a* and the second conductor 12*a* are each formed in a flat plate and are disposed facing each other. With this configuration, the electric length of each of the first conductor 11*a* and the second conductor 12*a* can be increased without increasing the size of the device. The electric power efficiency of the device can thereby be improved realizing downsizing thereof.

According to the high-frequency heating device 1E, the distribution of the magnetic field can be made even compared to the first embodiment. The heating of the heating object 50 by the magnetic field can therefore be made even.

According to the high-frequency heating device 1E, when the high-frequency voltage is applied between the first conductor 11*a* and the second conductor 12*a* by the high-frequency power source 20, in the portion having the first conductor 11*a* and the second conductor 12*a* therein facing each other, the direction of the current flowing through the first conductor 11*a* and the direction of the current flowing through the second conductor 12*a* are opposite directions to each other. With this configuration, the magnetic fields generated between the first conductor 11*a* and the second conductor 12*a* strengthen each other and the electric power efficiency can therefore be further improved.

Fifth Embodiment

A high-frequency heating device according to a fifth embodiment of the present invention will be described. The points different from the first embodiment will mainly be described in the fifth embodiment. In the fifth embodiment, configurations identical or similar to those of the first embodiment will be described being denoted by the same reference numerals. In the fifth embodiment, the same descriptions as those in the first embodiment will not again be made.

Figure 15:
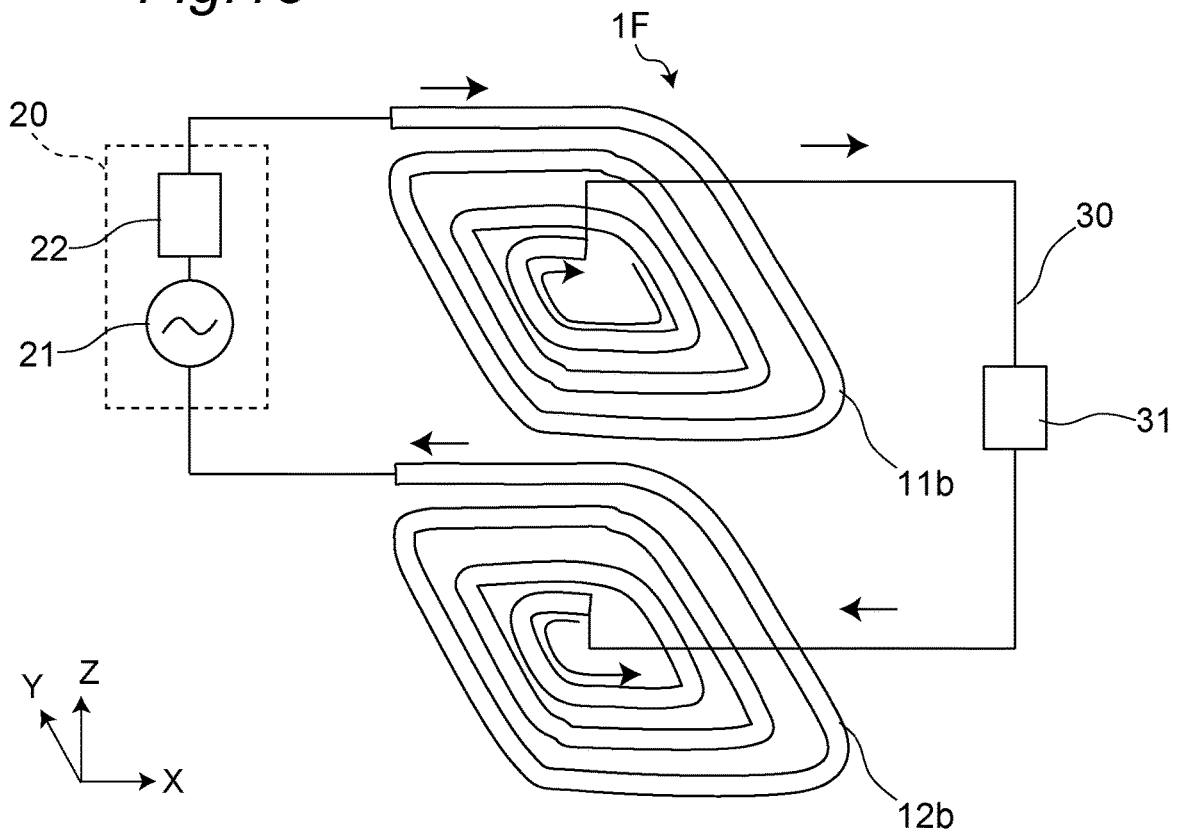
FIG. 15 is a diagram depicting one example of the basic configuration of a high-frequency heating device according to a fifth embodiment of the present invention.

FIG. 15 depicts one example of the basic configuration of a high-frequency heating device 1F according to the fifth embodiment of the present invention. As depicted in FIG. 15, the fifth embodiment differs from the first embodiment in that a first conductor 11*b* and a second conductor 12*b* are each formed in a spiral shape.

In the high-frequency heating device 1F, the first conductor 11*b* and the second conductor 12*b* each wind in a clockwise winding direction. For example, the first conductor 11*b* is wound such that other end of the first conductor 11*b* approaches toward the winding axis. The second conductor 12*b* is wound such that other end of the second conductor 12*b* approaches toward the winding axis. The first conductor 11*b* and the second conductor 12*b* are disposed facing each other.

In the fifth embodiment, the high-frequency power source 20 is connected to one end of the first conductor 11*b* and one end of the second conductor 12*b*. The connection path 30 is connected to the other end of the first conductor 11*b* and the other end of the second conductor 12*b*.

When the high-frequency voltage is applied between the first conductor 11*b* and the second conductor 12*b* by the high-frequency power source 20, in the portion having the first conductor 11*b* and the second conductor 12*b* therein facing each other, direction of the current flowing through the first conductor 11*b* and the direction of the current flowing through the second conductor 12*b* are opposite directions to each other.

Effects

According to the high-frequency heating device 1F of the fifth embodiment, the following effects can be achieved.

According to the high-frequency heating device 1F, the first conductor 11*b* and the second conductor 12*b* are each formed in a spiral shape and are disposed facing each other. With this configuration, the electric length of each of the first conductor 11*b* and the second conductor 12*b* can be increased without increasing the size of the device. The electric power efficiency of the device can thereby be improved realizing downsizing thereof.

According to the high-frequency heating device 1F, the distribution of the magnetic field can be made even compared to the first embodiment. The heating of the heating object 50 by the magnetic field can therefore be made even.

According to the high-frequency heating device 1F, in the portion having the first conductor 11*b* and the second conductor 12*b* therein facing each other, the direction of the current flowing through the first conductor 11*b* and the direction of the current flowing through the second conductor 12*b* are opposite directions to each other. With this configuration, the magnetic fields generated between the first conductor 11*b* and the second conductor 12*b* strengthen each other and the electric power efficiency can therefore be further improved.

The example where the first conductor 11*b* and the second conductor 12*b* are disposed facing each other in the height direction (the Y-direction) of the high-frequency heating device 1F has been described in the fifth embodiment while the disposition is not limited to this. The first conductor 11*b* and the second conductor 12*b* may to be disposed with each other through a space therebetween.

Figure 16:
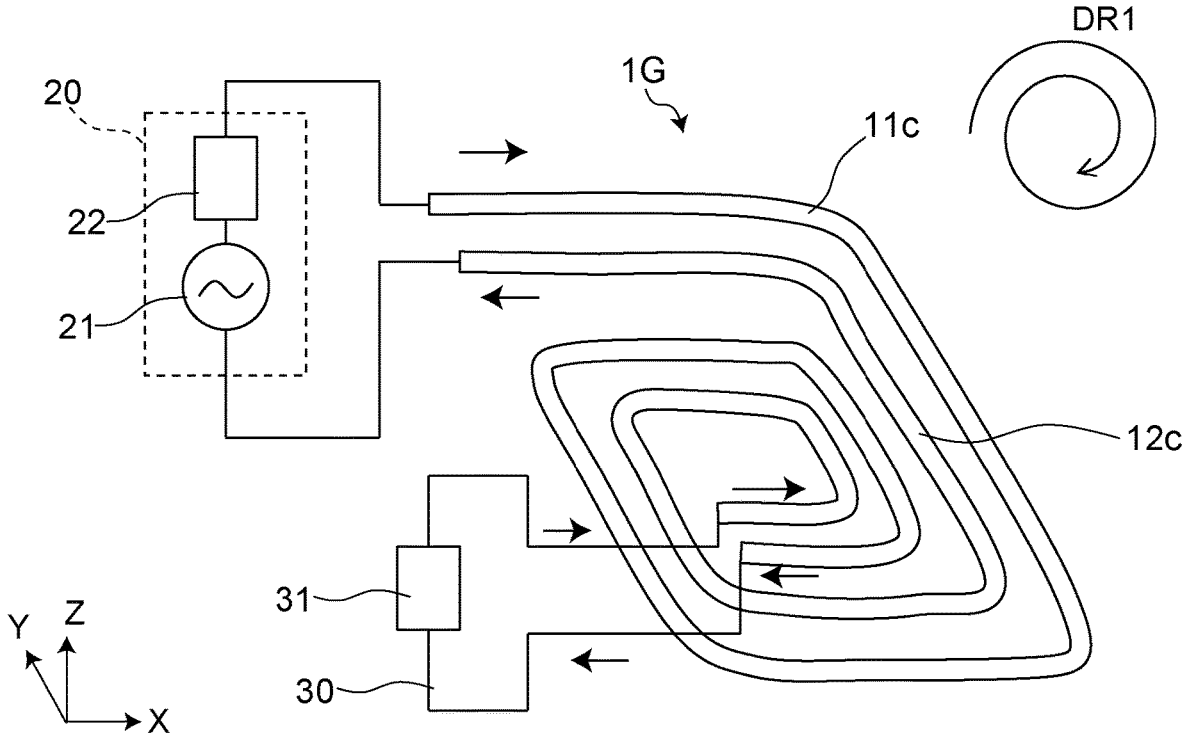
FIG. 16 is a diagram depicting one example of the basic configuration of the high-frequency heating device of Modification Example.

FIG. 16 is a diagram depicting one example of the basic configuration of a high-frequency heating device 1G of Modification Example. As depicted in FIG. 16, in the high-frequency heating device 1G, the first conductor 11*c* and the second conductor 12*c* are each formed in a spiral shape. The second conductor 12*c* is disposed on the inner side of the first conductor 11*c* along the winding direction DR1 of the first conductor 11*c*.

As above, the first conductor 11*c* and the second conductor 12*c* are disposed side by side through a space therebetween in the width direction (the X-direction) and the depth direction (the Y-direction) of the high-frequency heating device 1G. The heating object 50 is heated being placed on the first conductor 11*c* and the second conductor 12*c*. With this configuration, the heating object 50 can also be heated by the magnetic field and the electric field generated between the first conductor 11*c* and the second conductor 12*c*, and the electric power efficiency can be improved.

The present invention has been sufficiently described in relation to the preferred embodiments with reference to the accompanying drawings while various modifications and changes are obvious to those skilled in the art. It should be understood that such modifications and changes are encompassed by the present invention without departing from the scope of the present invention by the appended claims.

INDUSTRIAL APPLICABILITY

The high-frequency heating device according to the present invention is useful as a cooking home appliance such as, for example, a thawing machine or a heating cooking machine for foodstuff.

REFERENCE SIGNS LIST

1A, 1B, 1C, 1D, 1E, 1F, 1G high-frequency heating device
10 heating chamber
11, 11*a*, 11*b*, 11*c* first conductor
12, 12*a*, 12*b*, 12*c* second conductor
13 dielectric
20 high-frequency power source
21 high-frequency oscillator
22 matching circuit
30, 32 connection path
31, 31*a*, 31*b*, 33 matching part
40 controller
50 heating object
E11, E21 one end
E12, E22 other end
E13, E14, E23, E24 side end
L1, L2, L3, L4, L5 inductor
L11, L12 path
L21, L22, L23, L24 path
L31, L32, L33, L34 path
La path length
Pc1, Pc2, Pc3, Pc4 connection position
Pf1, Pf2, Pf3, Pf4 power feeding position
R1 resistor

The invention claimed is:

1. A high-frequency heating device comprising:

a first electrode;

a second electrode disposed with the first electrode through a space therebetween;

a high-frequency power source that is connected to the first electrode and the second electrode, the high-frequency power source applying a high-frequency voltage between the first electrode and the second electrode; and a connection path that electrically connects the first electrode and the second electrode to each other at a first connection position and a second connection position, the first connection position being different from a first power feeding position at which the first electrode and the high-frequency power source are connected to each other on the first electrode, and the second connection position being different from a second power feeding position at which the second electrode and the high-frequency power source are connected to each other on the second electrode, wherein a path length acquired by totaling those of the first electrode, the second electrode, and the connection path is ½ of a wavelength at an oscillation frequency of the high-frequency power source.

2. The high-frequency heating device according to claim 1, further comprising a matching part that is disposed in the connection path, the matching part establishing impedance matching between the first electrode and the second electrode.

3. The high-frequency heating device according to claim 2, wherein the matching part comprises an impedance element.

4. The high-frequency heating device according to claim 3, wherein the impedance element comprises at least any one of a resistor and an inductor.

5. The high-frequency heating device according to claim 3, wherein the matching part comprises a capacitor.

6. The high-frequency heating device according to claim 1, further comprising a dielectric that is disposed on at least any one of the first electrode and the second electrode, between the first electrode and the second electrode.

7. The high-frequency heating device according to claim 1, wherein the first electrode and the second electrode each comprise one end and other end, wherein the first power feeding position is disposed closer to a side of the one end of the first electrode than a center of the first electrode, wherein the second power feeding position is disposed closer to a side of the one end of the second electrode than a center of the second electrode, wherein the first connection position is disposed closer to a side of the other end of the first electrode than the center of the first electrode, and wherein the second connection position is disposed closer to a side of the other end of the second electrode than the center of the second electrode.

8. The high-frequency heating device according to claim 7, wherein the first power feeding position is disposed at the one end of the first electrode, wherein the second power feeding position is disposed at the one end of the second electrode, wherein the first connection position is disposed at the other end of the first electrode, and wherein the second connection position is disposed at the other end of the second electrode.

9. The high-frequency heating device according to claim 1, wherein the first electrode and the second electrode are each formed in a flat plate and are disposed facing each other.

10. The high-frequency heating device according to claim 1, wherein the first electrode and the second electrode are each formed in a meander and are disposed facing each other.

11. The high-frequency heating device according to claim 1, wherein the first electrode and the second electrode are each formed in a spiral shape and are disposed facing each other.

12. The high-frequency heating device according to claim 1, wherein the first electrode and the second electrode are each formed in a spiral shape, and wherein the second electrode is disposed on an inner side of the first electrode along a winding direction of the first electrode.

13. The high-frequency heating device according to claim 1, further comprising a matching part that is disposed in the connection path, the matching part establishing impedance matching between the first electrode and the second electrode, and a dielectric that is disposed on at least any one of the first electrode and the second electrode, between the first electrode and the second electrode.

14. The high-frequency heating device according to claim 1, further comprising a matching part that is disposed in the connection path, the matching part establishing impedance matching between the first electrode and the second electrode, wherein the first electrode and the second electrode are each formed in a flat plate and are disposed facing each other.

15. A high-frequency heating device comprising:

a first electrode;

a second electrode disposed with the first electrode through a space therebetween;

a high-frequency power source that is connected to the first electrode and the second electrode, the high-frequency power source applying a high-frequency voltage between the first electrode and the second electrode; and a connection path that electrically connects the first electrode and the second electrode to each other at a first connection position and a second connection position, the first connection position being different from a first power feeding position at which the first electrode and the high-frequency power source are connected to each other on the first electrode, and the second connection position being different from a second power feeding position at which the second electrode and the high-frequency power source are connected to each other on the second electrode, wherein the first electrode and the second electrode are each formed in a flat plate and are disposed facing each other, the connection path is a first connection path, the high-frequency heating device comprises a second connection path that electrically connects the first electrode and the second electrode to each other at a third connection position and a fourth connection position, the third connection position being different from the first power feeding position and the first connection position on the first electrode, and the fourth connection position being different from the second power feeding position and the second connection position on the second electrode.

16. The high-frequency heating device according to claim 15, wherein on the first electrode, a first path and a second path intersect with each other, the first path passing through the first power feeding position and the first connection position, and the second path passing through the first power feeding position and the third connection position, and wherein on the second electrode, a third path and a fourth path intersect with each other, the third path passing through the second power feeding position and the second connection position, and the fourth path passing through the second power feeding position and the fourth connection position.

17. The high-frequency heating device according to claim 15, wherein the high-frequency power source is connected to the first electrode and the second electrode at a third power feeding position and a fourth power feeding position, the third power feeding position being different from the first power feeding position, the first connection position and the third connection position on the first electrode, and the fourth power feeding position being different from the second power feeding position, the second connection position, and the fourth connection position on the second electrode, wherein on the first electrode, a fifth path and a sixth path are orthogonal to each other, the fifth path passing through the first power feeding position and the first connection position, and the sixth path passing through the third power feeding position and the third connection position, and wherein on the second electrode, a seventh path and an eighth path are orthogonal to each other, the seventh path passing through the second power feeding position and the second connection position, and the eighth path passing through the fourth power feeding position and the fourth connection position.

18. A high-frequency heating device comprising:

a first electrode;

a second electrode disposed with the first electrode through a space therebetween;

a high-frequency power source that is connected to the first electrode and the second electrode, the high-frequency power source applying a high-frequency voltage between the first electrode and the second electrode; and a connection path that electrically connects the first electrode and the second electrode to each other at a first connection position and a second connection position, the first connection position being different from a first power feeding position at which the first electrode and the high-frequency power source are connected to each other on the first electrode, and the second connection position being different from a second power feeding position at which the second electrode and the high-frequency power source are connected to each other on the second electrode; and a matching part that is disposed in the connection path, the matching part establishing impedance matching between the first electrode and the second electrode, wherein a path length acquired by totaling those of the first electrode, the second electrode, and the connection path is ½ of a wavelength at an oscillation frequency of the high-frequency power source.

19. A high-frequency heating device comprising:

a first electrode;

a second electrode disposed with the first electrode through a space therebetween;

a high-frequency power source that is connected to the first electrode and the second electrode, the high-frequency power source applying a high-frequency voltage between the first electrode and the second electrode; and a connection path that electrically connects the first electrode and the second electrode to each other at a first connection position and a second connection position, the first connection position being different from a first power feeding position at which the first electrode and the high-frequency power source are connected to each other on the first electrode, and the second connection position being different from a second power feeding position at which the second electrode and the high-frequency power source are connected to each other on the second electrode, wherein the first electrode and the second electrode are each formed in a flat plate and are disposed facing each other, direction of current flowing from the first power feeding position to the first connection position in the first electrode and direction of current flowing from the second connection position to the second power feeding position in the second electrode are opposite directions.

* * * * *